US008777520B2

(12) United States Patent
Lin

(10) Patent No.: US 8,777,520 B2
(45) Date of Patent: Jul. 15, 2014

(54) PILING APPARATUS

(75) Inventor: Wei-Chung Lin, Birmingham, AL (US)

(73) Assignee: MacLean Fogg Company, Mundelein, IL (US)

( * ) Notice: Subject to any disclaimer, the term of this patent is extended or adjusted under 35 U.S.C. 154(b) by 0 days.

(21) Appl. No.: 12/315,903

(22) Filed: Dec. 8, 2008

(65) Prior Publication Data

US 2010/0143048 A1 Jun. 10, 2010

(51) Int. Cl.
*E02D 5/74* (2006.01)
*E02D 27/48* (2006.01)

(52) U.S. Cl.
USPC ..... 405/230; 405/229; 405/244

(58) Field of Classification Search
USPC ..... 405/230, 231, 232, 244, 249, 250, 251; 52/293.1, 296; 403/348, 350, 361
See application file for complete search history.

(56) References Cited

U.S. PATENT DOCUMENTS

| | | | | |
|---|---|---|---|---|
| 5,622,015 | A * | 4/1997 | Collins | 52/160 |
| 6,468,003 | B2 * | 10/2002 | Merjan et al. | 405/253 |
| 6,814,525 | B1 * | 11/2004 | Whitsett | 405/233 |
| 7,165,915 | B2 * | 1/2007 | Queen | 405/244 |
| 7,314,335 | B2 | 1/2008 | Whitsett | |
| 2004/0076479 | A1 * | 4/2004 | Camilleri | 405/252.1 |
| 2005/0074298 | A1 * | 4/2005 | Jones | 405/252.1 |
| 2006/0269364 | A1 * | 11/2006 | May | 405/232 |

* cited by examiner

*Primary Examiner* — Benjamin Fiorello
(74) *Attorney, Agent, or Firm* — Brinks Gilson & Lione

(57) ABSTRACT

A piling is provided with a pipe provided with a generally cylindrical shape, a first end, and a second end. A first end fitting is located at the first end of the pipe and a second end fitting is located at the second end of the pipe. The first end fitting is provided with an out-of-round shape that transmits torque and is dimensioned so that at least a portion fits within the second end fitting, and the second end fitting is provided with an out-of-round shape that transmits torque with at least a portion that fits about a portion of the first end fitting.

5 Claims, 25 Drawing Sheets

PILING APPARATUS

FIELD OF THE INVENTION

This patent application relates to pilings and brackets used with pilings and foundations.

BACKGROUND OF THE INVENTION

Different components are used to create piling apparatuses. For example, it is known to use a bracket that is pushed under a foundation in combination with a pile (either a helically-driven pile or a resistance-style pile). However, current brackets suffer from a number of drawbacks. Because brackets must perform in the heavy loading conditions that exist in building foundations, brackets are currently fabricated by manually welding together steel components. This results in increased expense, lower throughput, and greater manufacturing variances as results differ from welder to welder. While variances can be eliminated by hiring highly-skilled welders, throughput will still depend upon the manufacturer's ability to find highly-skilled labor and the welds used in production being of a high quality. Furthermore, successful pile performance depends upon preventing the piles from buckling during installation.

The current invention overcomes these problems by offering a bracket that is a cast in a mold. By using a mold in its manufacture, the bracket disclosed herein dispenses with the need for highly skilled manual welding. Because welding is eliminated altogether, throughput can be increased dramatically and quality consistently maintained at a high level. The bracket disclosed herein also offers greater control over the eccentric force encountered while the piles are being driven into the ground. By controlling eccentric force, the bracket that is the subject of the instant application prevents buckling during installation.

Piling apparatuses currently in the market suffer from additional problems. In applications involving helically-driven piles, the joints represent areas of weakness. For example, in U.S. Pat. No. 7,314,335, the disclosure of which incorporated herein by reference, a cylindrical pile has been cold formed to provide a squared end that functions as a female connector adapted for mating engagement with a lower squared male end. See Col. 4, 11. 34-36. At the joint between the female squared end and the male squared end, holes are provided for bolts. See, e.g., FIG. 9. In U.S. Pat. No. 7,314,335, two power sources and a removable drive member extending through the entire length of the piles are used. One of the power sources is connected to the drive member whereby torque is transmitted to the anchor, driving it into the ground; the second power source is mounted onto the pile and causes the pile section to rotate independently and separately from the drive member. See Col. 5, line 59 to Col. 6, line 10. However, when soil conditions require increased torque in order to drive the anchor into the ground, the pile buckles at the joint or the male and female ends move relative to each other with the bolt cutting through the wall of one of the piles. Consequently, there is a need for greater strength at the joints.

The ends of the piling shown herein are provided with a thickness that is greater than the thickness of the pipe. The greater thickness at the ends provides strength. In the presently preferred embodiment, this is accomplished by welding end fittings to the ends of the pipe (though other means of attachment are possible). These end fittings provide a cost-effective solution to the problem of weakness at the joints. First, the end fittings are cast in a sand mold. The cast design enables many end fittings to be made, thereby reducing the cost per end fitting. Second, in the case of the preferred embodiment, welding the end fitting onto a pile requires minimal skill and can be fully automated; thus, the piles disclosed herein can be made in a cost-effective manner. Third, the cast steel end fitting provides considerable strength that enables the pile to withstand the increased stress encountered when the pile is being driven into the ground. Finally, two power sources and an extensive drive member are not necessary to install the pile into the ground.

Accordingly, the present invention is intended to overcome these and other disadvantages inherent in prior systems. Naturally, the foregoing does not purport to be an exhaustive illustration of the advantages of the current piling apparatus. The detailed description will reveal other advantages of the current piling apparatus.

SUMMARY OF THE INVENTION

The present invention is defined by the appended claims; nonetheless, applicant respectfully submits that the present invention relates to a piling, comprising a pile that includes, a pipe provided with a generally cylindrical shape, a first end, and a second end, a first end fitting located at the first end of the pipe, a second end fitting located at the second end of the pipe, the first end fitting is provided with an out-of-round shape that transmits torque and is dimensioned so that at least a portion fits within the second end fitting, and the second end fitting is provided with an out-of-round shape that transmits torque with at least a portion that fits about a portion of the first end fitting.

DETAILED DESCRIPTION OF THE PRESENTLY PREFERRED EMBODIMENTS

Figure 1:
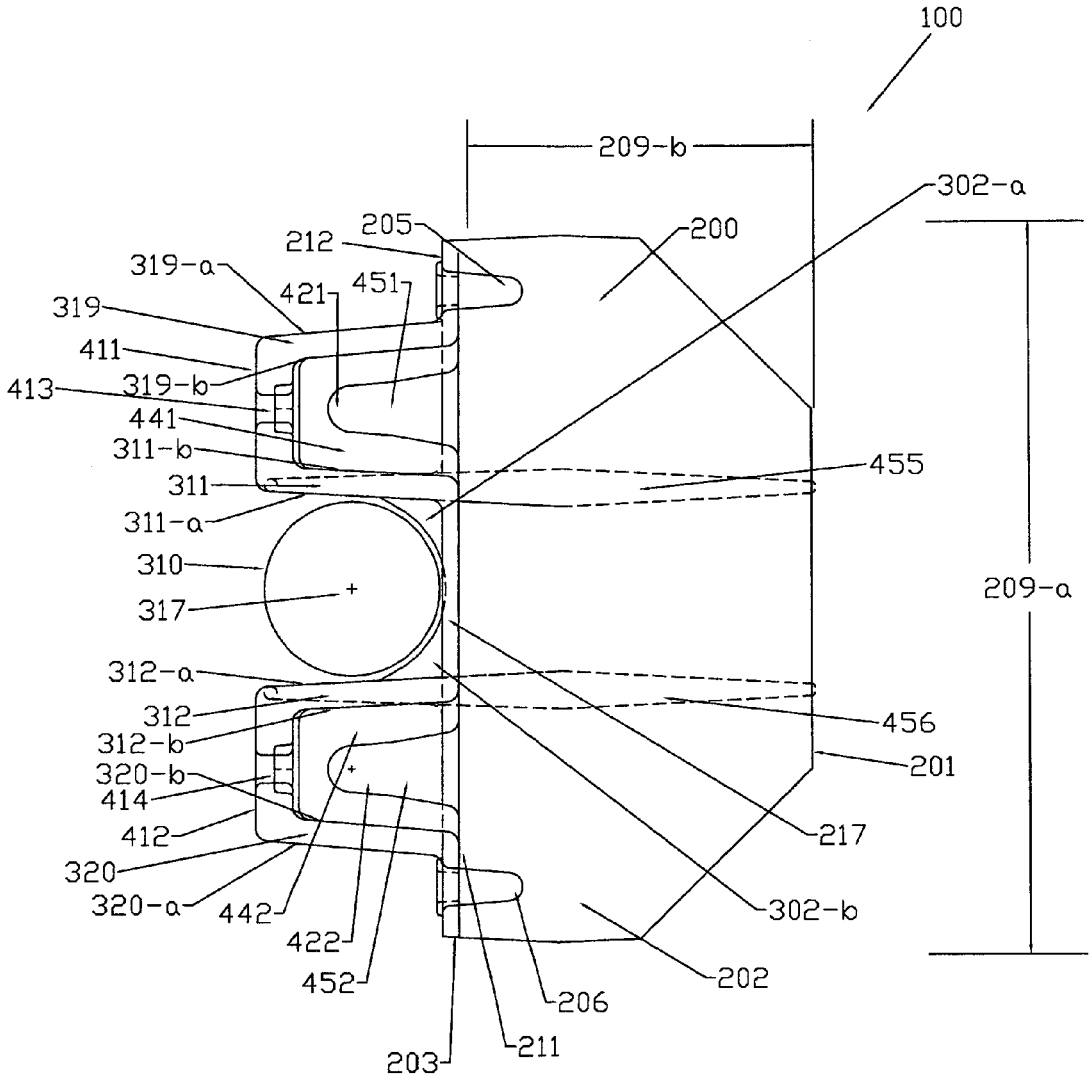
FIG. 1 depicts a top-down view of one embodiment of a bracket.
Figure 2:
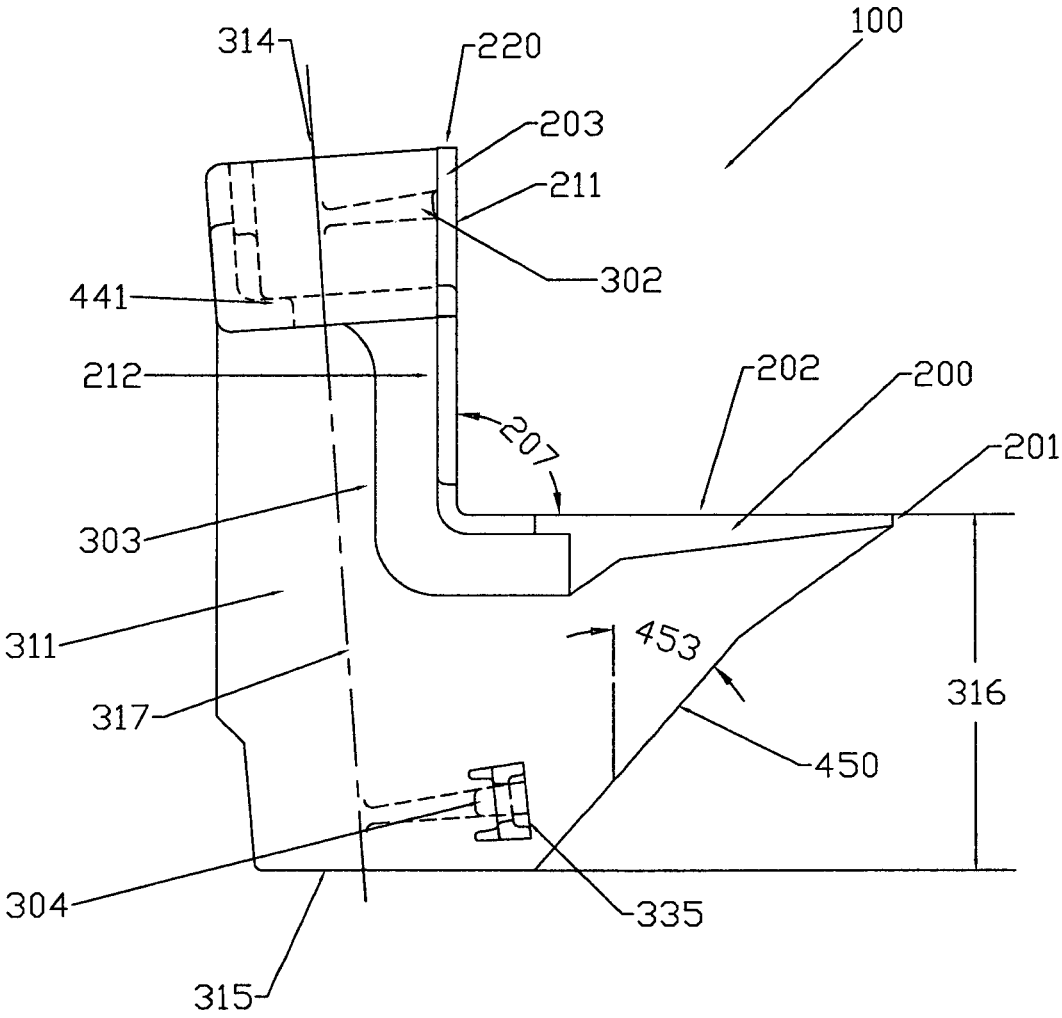
FIG. 2 depicts a cross-sectional view of one embodiment of the bracket.
Figure 4:
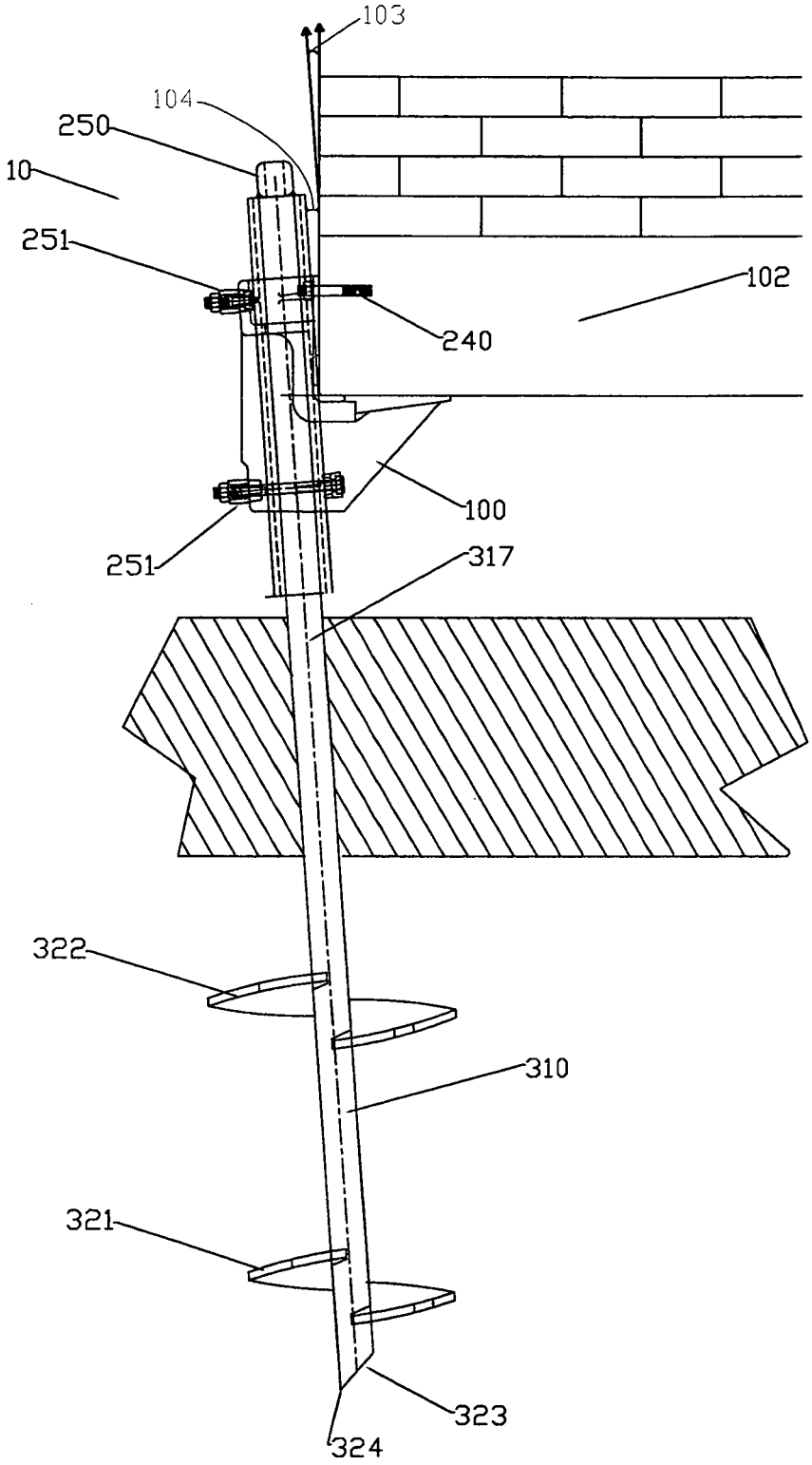
FIG. 4 depicts a side view of the bracket attached to a foundation.

FIG. 1 depicts a presently preferred embodiment of a bracket 100. As shown therein, the bracket 100 is provided with a supporting structure 200. The supporting structure 200 is provided with a leading edge 201 that is shaped to be driven under a foundation 102, as illustrated in FIG. 4. The supporting structure 200 is also provided with a support area 202 and a support backing 203. As shown in FIG. 2, the support area 202 and the support backing 203 are oriented to be orthogonal to one another; however, in alternative embodiments, the support area 202 and the support backing 203 form an angle 207 that ranges from 85° to 95°.

FIG. 4 depicts a piling apparatus 10 constituting a presently preferred embodiment of the present invention. The bracket 100 is shown secured to a foundation 102, by way of a fastener 240. As shown therein, the piling apparatus 10 includes a bracket 100, a pile 310, a supporting T-pipe 250, FIG. 11 and a back-strap 251. In operation, the bracket 100 is secured to a footing or foundation 102. The supporting T-pipe 250 is placed into the bracket 100 to support the foundation 102 after the pile 310 is driven to the ground. The back-strap 251 is used to secure the supporting T-pipe 250 and pile 310 to the bracket 100 while the bracket 100 is secured to a footing or foundation 102 via a fastener such as a bolt 240.

Figure 5:
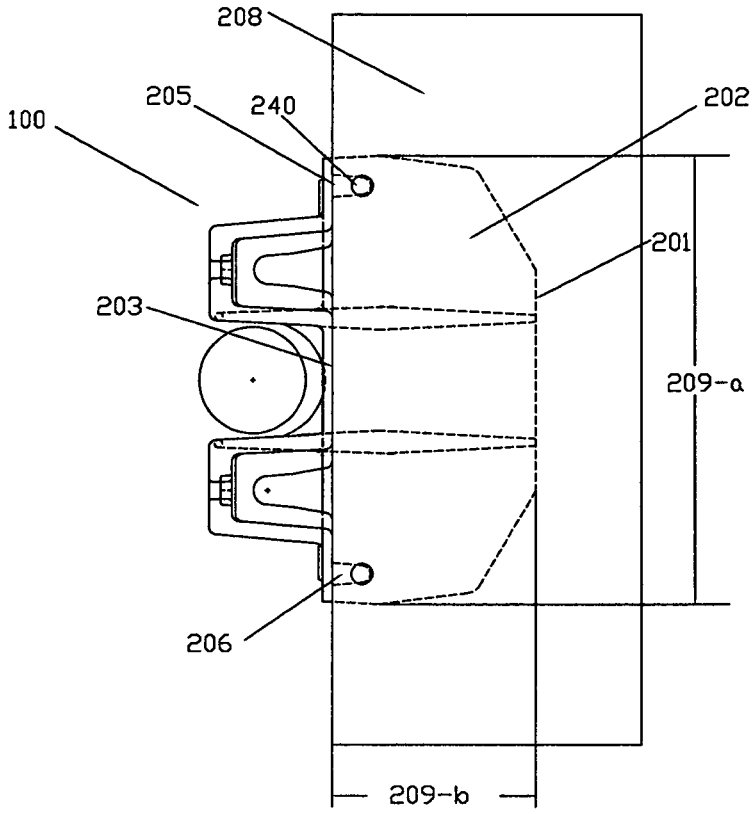
FIG. 5 depicts a top-down view of a steel plate attached to the bracket.
Figure 6:
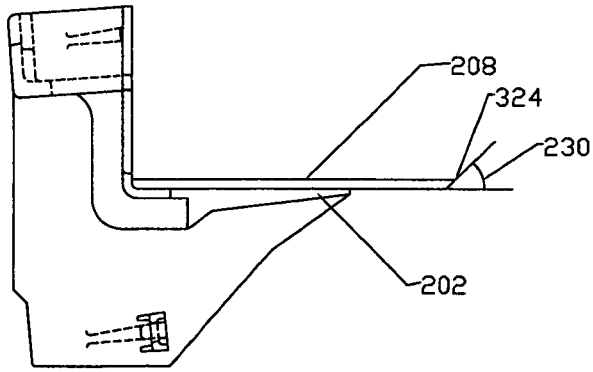
FIG. 6 depicts a cross-sectional view of one embodiment of the steel plate.

Referring back to FIG. 1, the support area 202 defines a plurality of support slots 205, 206. Each of the support slots 205, 206 is shaped to accept a fastener, such as a bolt. Advantageously, in certain applications, the fastener can be used to secure to the supporting structure 200 to yet another supporting structure with a larger area; by way of example and not limitation, a steel plate 208 with holes drilled to accept fasteners can be bolted to the support area 202. Thus, the width 209-*a* and the length 209-*b* of the support area 202 can be increased to a larger size, such as 32 inches by 12 inches as depicted in FIG. 5. As depicted in FIG. 6, the steel plate 208 includes an angle 230 for driving under the foundation 102.

Figure 3:
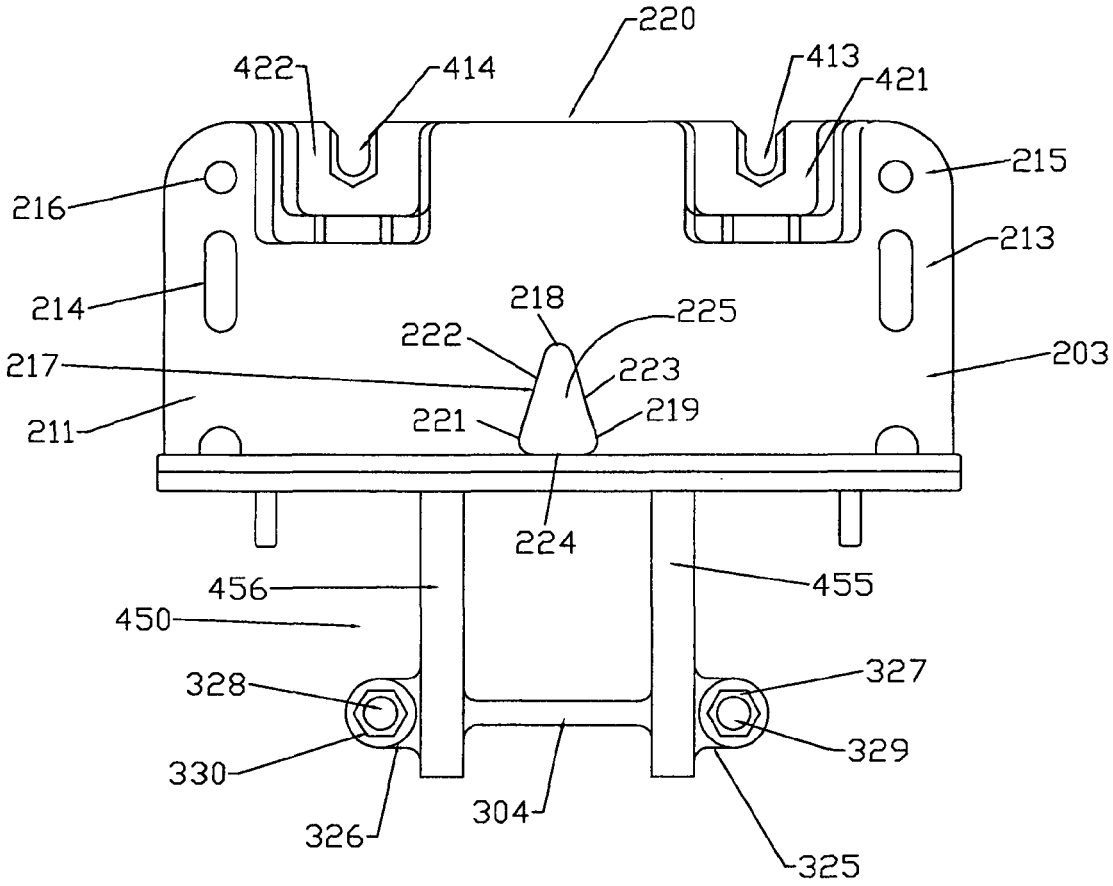
FIG. 3 depicts a front view of one embodiment of the bracket.

FIG. 3 depicts the support backing 203 in greater detail. As shown therein, the support backing 203 is a plate (which may be cast) provided with a first backing surface 211 that faces the foundation 102 and a second backing surface 212, depicted in FIG. 2. The first backing surface 211 and the second backing surface 212 are located on opposing sides of the support backing 203. The support backing 203 extends from the support area 202 and terminates at a backing edge 220. Defined within the support backing 203 are a plurality of backing slots 213, 214 and backing holes 215, 216. As illustrated in FIG. 3, the backing slots 213, 214 are located on opposing sides of the support backing 203. The backing slots 213, 214 and backing holes 215, 216 are shaped to accept a fastener 240, such as bolt, for securing the bracket 100 to the side of the foundation 102, as is illustrated in FIG. 4.

Referring again to FIG. 1, the bracket 100 is provided with two walls 311, 312 that are oriented to be orthogonal relative to the support area 202. The walls 311, 312 are provided with two ends 314, 315, as shown in FIG. 2. As used herein, the term "end" is intended broadly to encompass the extreme end as well as portions of at least one of the walls 311, 312 adjacent to the extreme end. A first end 314 generally begins at the backing edge 220 while a second end 315 is generally located a distance 316 from the support area 202. Extending along the second backing surface 212, the walls 311, 312 are spaced from one another so as to accommodate a pile 310, which, in FIG. 1, takes the form of a helical anchor. The pile 310 is provided with an axis 317 that extends between the walls 311, 312. The walls 311, 312 maintain the pile 310 so that its axis 317 is between two and five degrees relative to the plane of the support backing 203. The distance between the first wall 311 and the second wall 312 allows the bracket 100 to receive piles 310 having diameters between 1½ inches and 3½ inches. One with skill in the art will understand after reading this disclosure that the current design can simply be scaled up for use on larger pipes.

As FIG. 1 illustrates, in the preferred embodiment, the walls 311, 312, together with the second backing surface 212, provide a guide 301 for the pile 310. Each of the walls (first wall 311 and second wall 312) is provided with an inner wall surface 311-*a*, 312-*a*. Each of the inner wall surfaces 311-*a*, 312-*a* face each other and are located within the guide 301. Each of the walls 311, 312 are provided with an outer wall surface 311-*b*, 312-*b*, each of which faces away from the other and the guide 301. As FIG. 1 illustrates, the inner wall surface 311-*a* of the first wall 311 is located on the opposing side of the wall 311 from the outer wall surface 311-*b*. Similarly, the inner wall surface 312-*a* of the second wall 312 is located on the opposing side of the wall 312 from the outer wall surface 312-*b*.

Preferably, the walls 311, 312 and the second backing surface 212 are shaped according to the pile 310, or supporting T-pipe 250. With the walls 311, 312 and the second backing surface 212 shaped according to the pile 310, or supporting T-pipe 250, the pile 310 and its axis 317 are more securely maintained in an orthogonal orientation relative to the plane of the support area 202.

FIG. 1 depicts a third wall 319 and a fourth wall 320 attached to the support backing 203. The third wall 319 and the fourth wall 320 are provided with an inner wall surface 319-*a*, 320-*a*, each of which face one another. The third wall 319 and the fourth wall 320 are provided with an outer wall surface 319-*b* and 320-*b*, each of which face away from one another. The third wall 319 is spaced from the first wall 311 and the inner wall surface 319-*a* of the third wall 319 faces the outer wall surface 311-*b* of the first wall 311. The first wall 311 and the third wall 319 form an angle that measures between 2 and 10 degrees; however, in alternative embodiments, the first wall 311 and the second wall 312 form an angle that measures between 2 and 10 degrees. The third wall 319 is spaced from the first wall 311 and the inner wall surface 319-*a* of the third wall 319 faces the outer wall surface 311-*a* of the first wall 311. The fourth wall 320 is spaced from the second wall 312 and the inner wall surface 320-*a* of the fourth wall 320 faces the outer wall surface 312-*a* of the second wall 312. The second wall 312 and the fourth wall 320 are oriented to be parallel to one another; however in alternative embodiments, the second wall 312 and the fourth wall 320 form an angle that measures between 2 and 10 degrees.

Referring now to FIGS. 1, 2, and 3, a plurality of curved guide ribs 302, 304 are provided. The guide ribs 302, 304 of the preferred embodiment are in the form of a plurality of guide rib segments 302-*a*, 302-*b*. FIG. 1 illustrates the guide rib segments 302-*a*, 302-*b* of guide rib 302; as shown therein, each of the guide rib segments 302-*a*, 302-*b* is located at the base of each of the walls 311, 312 on the second backing surface 212, with guide rib segment 302-*a* located at the base of wall 311 and guide rib segment 302-*b* located at the base of wall 312. Advantageously, the guide rib 302 (and the guide rib segments) are shaped to be cylindrical, according to the cylindrical shape of the pile 310, or supporting T-pipe 250. As is shown in FIG. 3, the guide ribs 302, 304 are spaced along the guide 301, with guide rib 302 located at the first end 314 of the walls 311, 312. The guide rib segments 302-*a*, 302-*b* increase the strength of the walls 311, 312, as well as align the pile 310 and supporting T-pipe 250.

Referring now to FIG. 2, the first and second walls 311, 312 are provided with two ends 314, 315. As used herein, the term "end" is intended broadly to encompass the extreme end as well as portions of at least one of the first or second walls 311, 312 adjacent to the extreme end. A first end 314 generally begins at the backing edge 220 while a second end 315 is generally located adjacent to the stand shelf 441.

In the presently preferred embodiment, the guide rib 304 is located at the second end 315 of the walls 311, 312. Unlike guide rib 302 which is located on the second backing surface 212, guide rib 304 is spaced away from the second backing surface 212 but oriented to be co-planar with the second backing surface 212. Thus, guide rib 304 prevents the pile 310 from tilting away from the second backing surface 212.

FIG. 1 depicts the stand couplers 421, 422; each of the stand couplers 421, 422 is provided with a stand shelf. As shown in FIG. 1, the first stand coupler 421 is provided with a first stand shelf 441 while the second stand coupler 422 is provided with a second stand shelf 442. The stand shelves 441, 442 extend from the second backing surface 212 form an angle that measures between 2 and 6 degrees relative to the plane of the second backing surface 212. Each of the stand shelves 441, 442 defines an attachment slot; as FIG. 1 depicts, the first stand shelf 441 is provided with a first attachment slot 451 while the second stand shelf 442 is provided with a second attachment slot 452. Each of the attachment slots 451, 452 accommodates a threaded rod or bolt that secures supporting T-pipe 250 to the bracket 100.

Referring now to FIG. 2, the bracket 100 includes a bracing section 450. The bracing section 450 braces the support area 202 when the support area 202 is loaded with a foundation 102. As shown in FIG. 2, the bracing section 450 is comprised of two bracing plates, a first bracing plate 455 and a second bracing plate 456. At the second end 315, each of the bracing plates 455, 456 extend from the walls 311, 312, with the first bracing plate 455 extending from the first wall 311 and the second bracing plate 456 extending from the second wall 312. Referring back to FIG. 3, the bracing plates 455, 456 extend under the support area 202 from the second end 315 at an angle 453. In the preferred embodiment, the angle 453 measures between 30 and 60 degrees. However, in alternative embodiments, the bracing plates 455, 456 may extend to the support area 202 via a curving or box-like configuration.

In one embodiment, the bracket 100 is cast in one piece from iron, resulting in a cast iron bracket 100. In alternative embodiments the bracket 100 is cast from ductile or gray iron. In another embodiment the bracket 100 is cast from malleable iron. In one embodiment, the bracket 100 is cast in one piece. In another embodiment, the bracket 100 is cast from steel. In another embodiment, the bracket 100 is fabricated from a metal and welded together. In one embodiment, the metal is steel.

Referring now to FIG. 3, the support backing 203 is provided with an aligner 217. The aligner 217 includes a plurality of surfaces located between the first backing surface 211 and the second backing surface 212. As depicted in FIG. 3, the aligner 217 is provided with a first curved surface 218, a second curved surface 219, and a third curved surface 221. The aligner 217 further includes a first angled surface 222, a second angled surface 223, and a third angled surface 224. The curved surfaces 218, 219, 221 and the angled surfaces 222, 223, 224 cooperate to form an aligner cavity 225, which, in the presently preferred embodiment, is in the form of an aperture defined within the support backing 203. Referring now to FIG. 1, the aligner 217 is located between the first wall 311 and the second wall 312. As shown therein, the aligner 217 is spaced from the backing edge 220. As illustrated in FIG. 4, during operation, the pile 310 is located within the aligner cavity 225.

FIG. 4 illustrates the pile axis 317 oriented to be at angle 103 relative to the plane of the backing surfaces 211, 212. In the preferred embodiment, the foundation 102 is exposed at the aligner cavity 225. After the foundation 102 is exposed, the installer is able to chip away a recess (not shown) for the pile 310 to pass through. As illustrated in FIG. 4, the pile must extend beneath the foundation 102, even though the pile 310 is driven into the ground from a location that is adjacent to the foundation 102. As a result, and as FIG. 4 illustrates, the pile necessarily must be oriented at an angle 103 relative to the backing surfaces 211, 212. By virtue of the angle 103, the pile axis 317 extends a distance 104 from the second backing surface 212. By virtue of the aligner 217, the distance 104 between the pile axis 317 and the second backing surface 212 is reduced. Thus, the aligner 217 cooperates with the pile 310 so that the pile 310 is located closer to the foundation 102 and therefore oriented to form an angle 103 that measures between 2 and 6 degrees relative to the plane of the backing surfaces 211, 212.

As depicted in FIG. 3, the bracket 100 includes a first lug 325 and a second lug 326. As shown therein, the first lug 325 is located on the first bracing plate 455, and the second lug 326 is located on the second bracing plate 456. The first lug 325 includes a hex recessed 327 and with round hole 329. Similarly, the second lug 326 includes a hex recessed 328 and with round hole 330. The hex recess shaped to accept the head of the bolt to prevent it from rotating when tightening.

Figure 7:
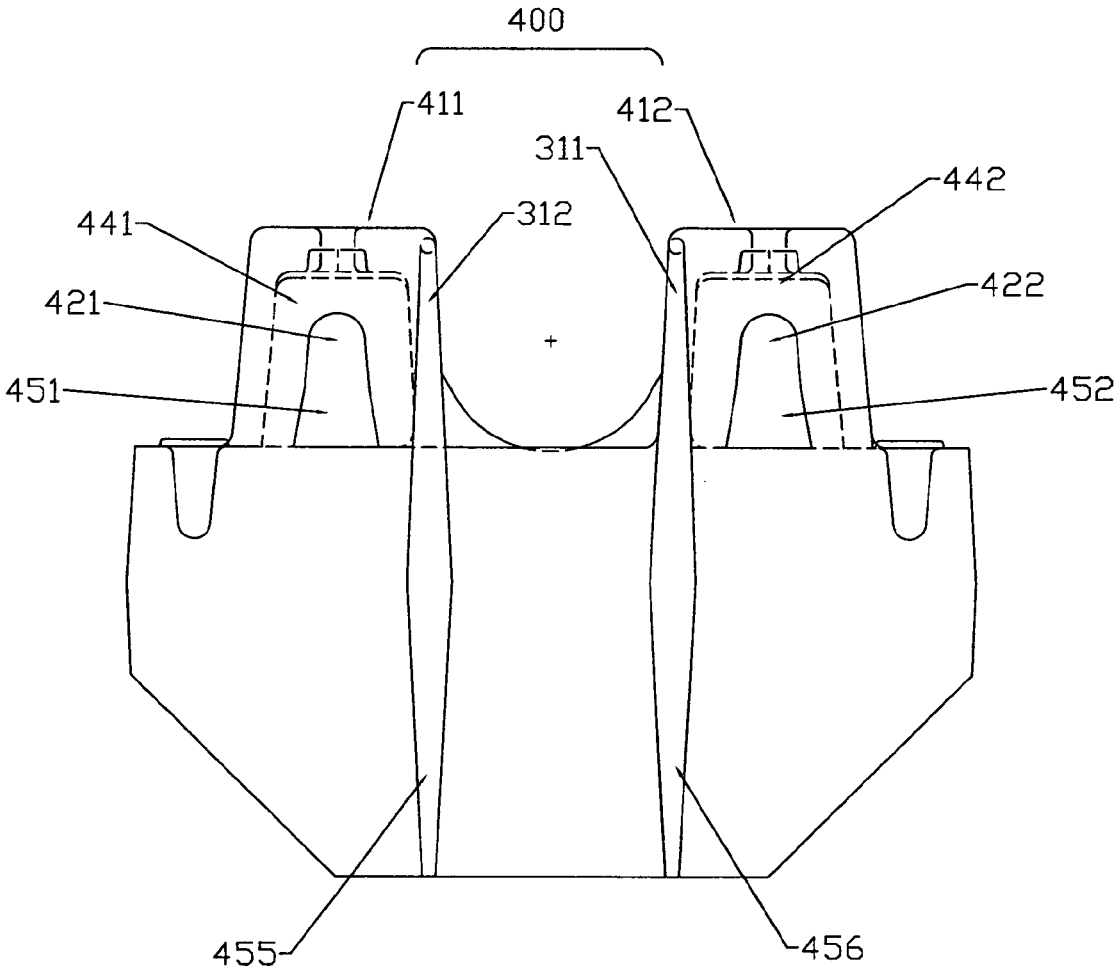
FIG. 7 depicts a bottom-up view of one embodiment of the bracket.

FIG. 7 depicts another embodiment of the bracket 100. As shown therein, located at the first end 314 is an attachment structure 400. The attachment structure 400 is provided with a plurality of attachment faces 411, 412 (referred to in FIG. 7 as a first attachment face 411 and a second attachment face 412). Each of the attachment faces 411, 412 extends from each of the outer wall surfaces 311-*b*, 312-*b*; thus, the first attachment face 411 extends from, and is generally orthogonal to, the outer wall surface 311-*b* of the first wall 311 while the second attachment face 412 extends from, and is generally orthogonal to, the outer wall surface 312-*b* of the second wall 312. The attachment faces 411, 412 are generally form an angle that measures between 2 and 6 degrees relative to the plane of the second backing surface 212 and are provided with slots 413, 414, with the first attachment face 411 provided with a first slot 413 and the second attachment face 412 provided with a second slot 414.

FIG. 7 depicts the stand couplers 421, 422; each of the stand couplers 421, 422 is provided with a stand shelf. As shown in FIG. 7, the first stand coupler 421 is provided with a first stand shelf 441 while the second stand coupler 422 is provided with a second stand shelf 442. The stand shelves 441, 442 extend from the second backing surface 212 and form an angle that measures between 2 and 6 degrees to the plane of the second backing surface 212. Each of the stand shelves 441, 442 defines an attachment slot; as FIG. 7 depicts, the first stand shelf 441 is provided with a first attachment slot 451 while the second stand shelf 442 is provided with a second attachment slot 452. Each of the attachment slots 451, 452 accommodates a rod, pin, or fastener.

Figure 8:
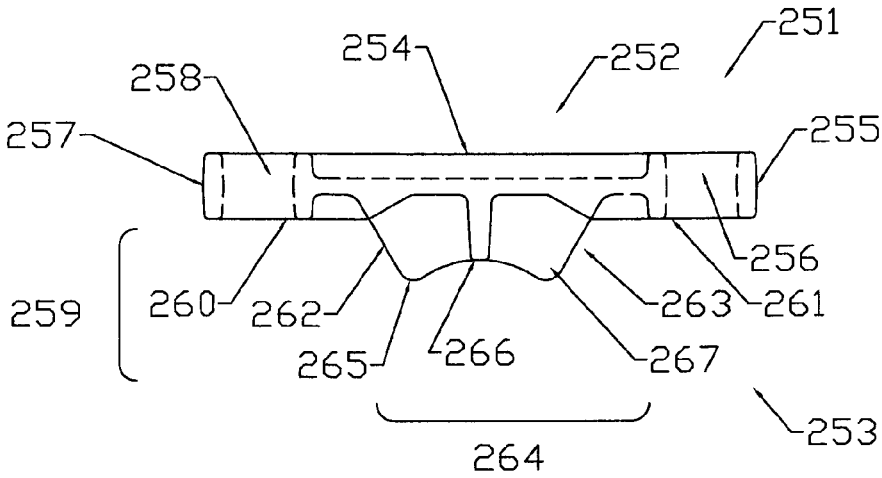
FIG. 8 depicts a top-down view of one embodiment of the bracket strap.

Referring now to FIG. 8, one embodiment of the back strap 251 is illustrated therein. The back strap 251 is provided with a first side 252 and a second side 253. The first side 252, of the back strap 251, is provided with a generally flat surface 254. The generally flat surface 254 is located between a first hole 256 and a second hole 258. The first hole 256 is located at the first end 255 of the back strap 252, and the second hole 258 is located at the second end 257 of the back strap 252. In alternative embodiments, the first hole 256 is spaced from the first end 255, and the second hole 258 is spaced from the second end 257. Located between the first hole 256 and the second hole 258, on the second side 253, is a protruding surface 259.

In one embodiment, the back strap 251 includes a second side 253 with a first flat surface 260 and a second flat surface 261. As illustrated in FIG. 8, the protruding surface 259 is located between the first flat surface 260 and the second flat surface 261. The protruding surface 259 includes a first angled surface 262 and a second angled surface 263 that extend from the second side 253 at an angle. In one embodiment, the first angled surface 262 is positioned at an angle between 90 and 160 degrees relative to the first flat surface 260. In a preferred embodiment, the first angled surface 262 is positioned at an angle between 110 and 140 degrees. The second angled surface 263 is positioned at an angle between 110 and 140 degrees relative to the second flat surface 261. However, in alternative embodiments, the angled surfaces 262, 263 may be curved, concave or convex; and in yet another embodiment, the angled surface may be frusto-conical in shape.

As illustrated in FIG. 8, located between the first angled surface 262 and the second angled surface 263 is a cooperating surface 264. In the embodiment depicted therein, the cooperating surface includes a first curved surface 265, a second curved surface 266, and a third curved surface 267. The cooperating surface 264 locates the supporting T-pipe 250, or the pile 310, in order to position the pile 310 with respect to the bracket 100. In one embodiment, the cooperating surface 264 is located between the first hole 256 and the second hole 258, as well as spaced from the second side 253. One of ordinary skill in the art would recognize that the cooperating surface 264 may be shaped of any surface that cooperates with the supporting T-pipe 250, or the pile 310, to locate the pile 310 with respect to the bracket 100. In alternative embodiments, the cooperating surface is angled, concave, convex, or frusto-conial.

Figure 9:
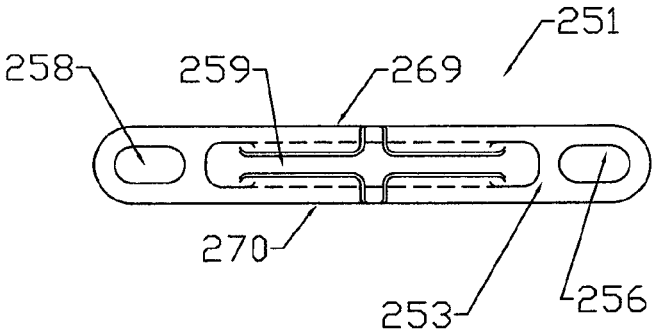
FIG. 9 depicts a front view of one embodiment of the bracket strap.
Figure 10:
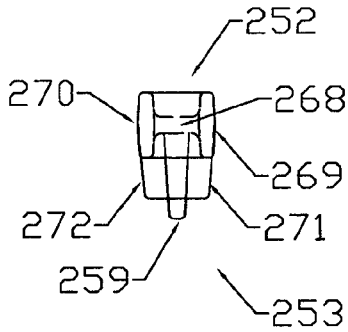
FIG. 10 depicts a side view of one embodiment of the bracket strap.

As illustrated in FIG. 9, the first side 252 of the back strap 251 includes a structural rib between a third side 269 and a fourth side 270. As shown therein, the structural rib 268 is located between the first hole 256 and the second hole 258. As illustrated in FIG. 10, the back strap 251 includes two angled protruding surfaces 271 and 272. The angled protruding surface 271 extends from third side 269 and intersects with the cooperating surface 264. The angled protruding surface 272 extends from fourth side 270 and intersects with the cooperating surface 264. In one embodiment, the angled protruding surface 271 is positioned at an angle of between 3 and 30 degrees relative to the third side 269. In one embodiment, the angled protruding surface 272 is positioned at an angle of between 3 and 30 degrees relative to the forth side 270. In a preferred embodiment, the angled protruding surface 271 is positioned at an angle of between 3 and 10 degrees relative to the third side 269. In a preferred embodiment, the angled protruding surface 272 is positioned at an angle of between 3 and 10 degrees relative to the fourth side 270.

In one embodiment, the back strap 251 is cast in one piece from iron, resulting in a cast iron back strap 251. In alternative embodiments the back strap 251 is cast from ductile or gray iron. In another embodiment the back strap 251 is cast from malleable iron. In another embodiment, the back strap 251 is cast from steel. In another embodiment, the back strap 251 is fabricated from a metal and welded together. In one embodiment, the metal is steel.

Figure 11:
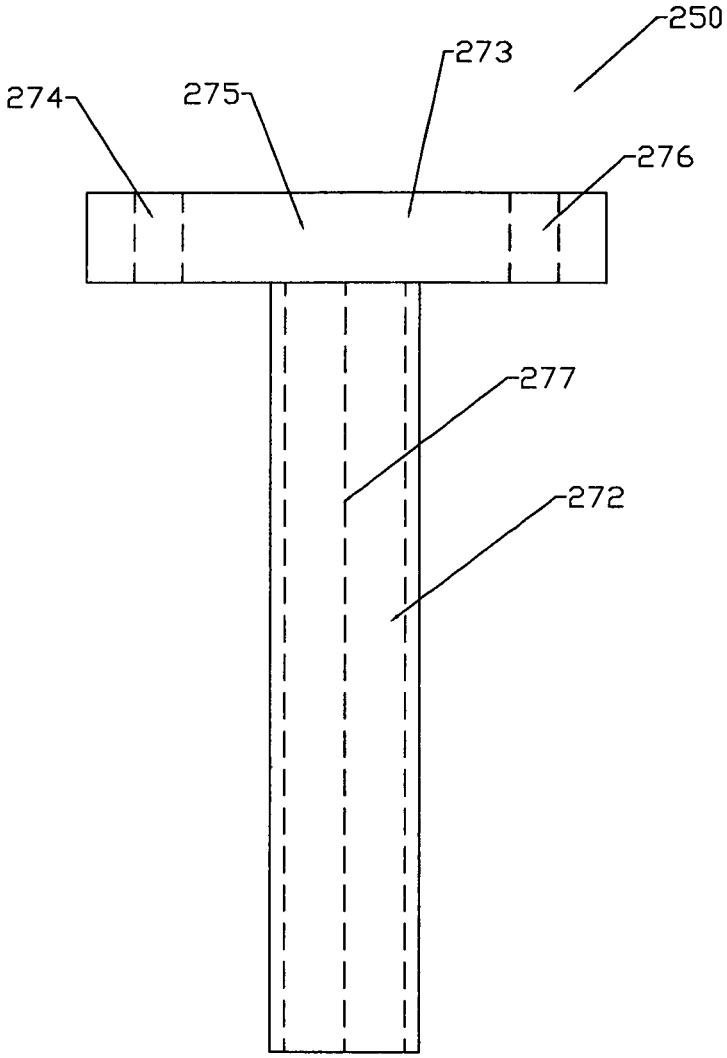
FIG. 11 depicts one embodiment of a supporting T-pipe.
Figure 12:
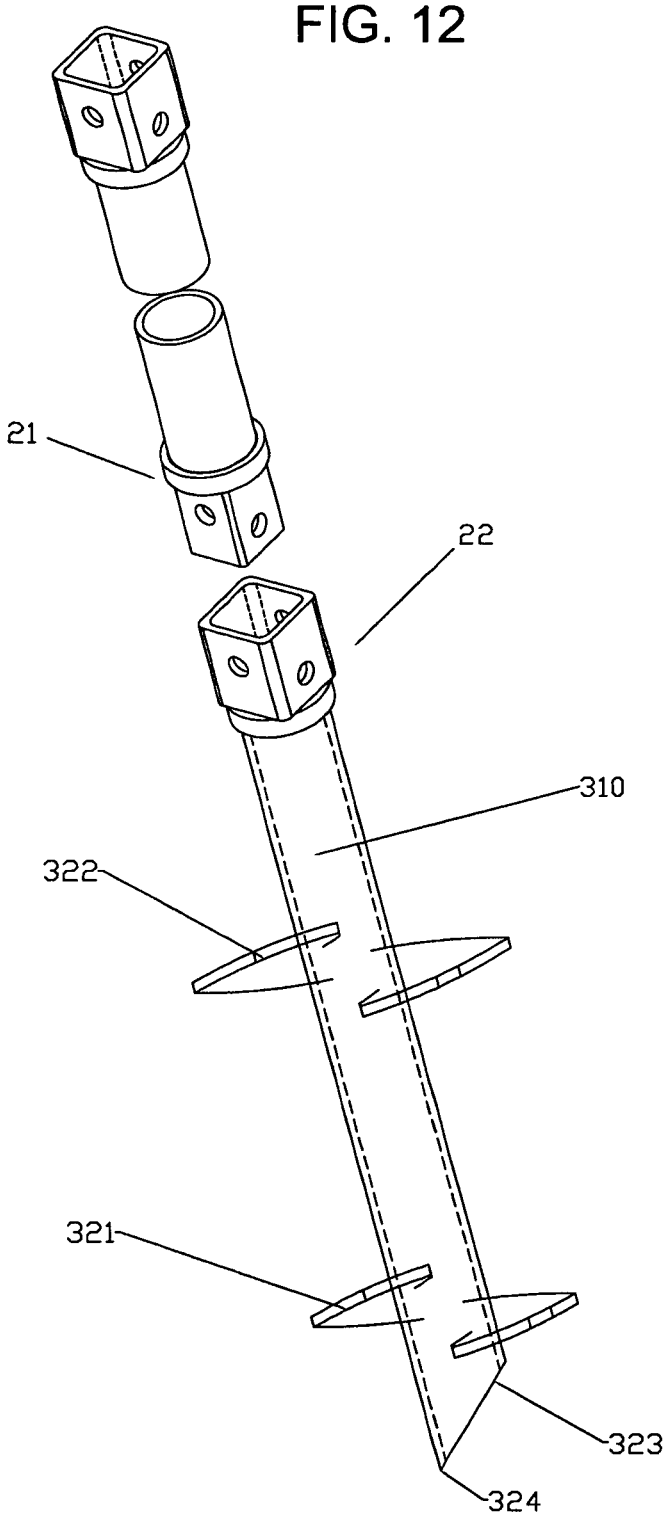
FIG. 12 depicts a view of the square coupling on pipe shaft.

Referring now to FIG. 11, one embodiment of the supporting T-pipe 250 is shown. The supporting T-pipe 250 includes a guide section 272 that provides a guide for receiving and aligning the pile 310. The guide section 272 includes an axis 277. In one embodiment, the pile 310 includes a 1½ inch round corner square shaft. In one embodiment, the pile 310 includes a 1¾ inch round corner square shaft. In one embodiment, the pile 310 includes a 2 inch round corner square shaft. In one embodiment, the pile 310 includes a 2⅞ inch round pipe. In one embodiment, the pile 310 includes a 3½ inch round pipe. In another embodiment, the pile 310 includes a 3½ inch round pipe. As one of ordinary skill in the art recognizes, the guide section 272 may include a number of different cross-sections, so long as the guide section 272 provides a guide for the pile 310.

Located generally orthogonal to the guide section 272 is a generally orthogonal plate 273. The generally orthogonal plate 273 includes a first plate hole 274, a second plate hole 275, and a third plate hole 276. The second plate hole 275 is generally aligned with the axis 277 of the guide section 272, and allows the pile 310 to pass through the second hole 275 and into the guide section 272.

As depicted in FIG. 4, the supporting T-pipe 250 is secured to the bracket 100 by way of a fastener and the back strap 251. In the embodiment depicted in FIG. 4, the fastener is a nut and bolt, however, alternative fasteners may also be employed. As illustrated in FIG. 4, the second side 253 of the back strap 251 contacts the supporting T-pipe 250. In one embodiment, the protruding surface 259 cooperates with the supporting T-pipe 250. The fasteners cooperate with the support lugs 325, 326 and the first and second holes 256, 258 of the back strap 251 to secure the supporting T-pipe 250 to the bracket 100.

Figure 13:
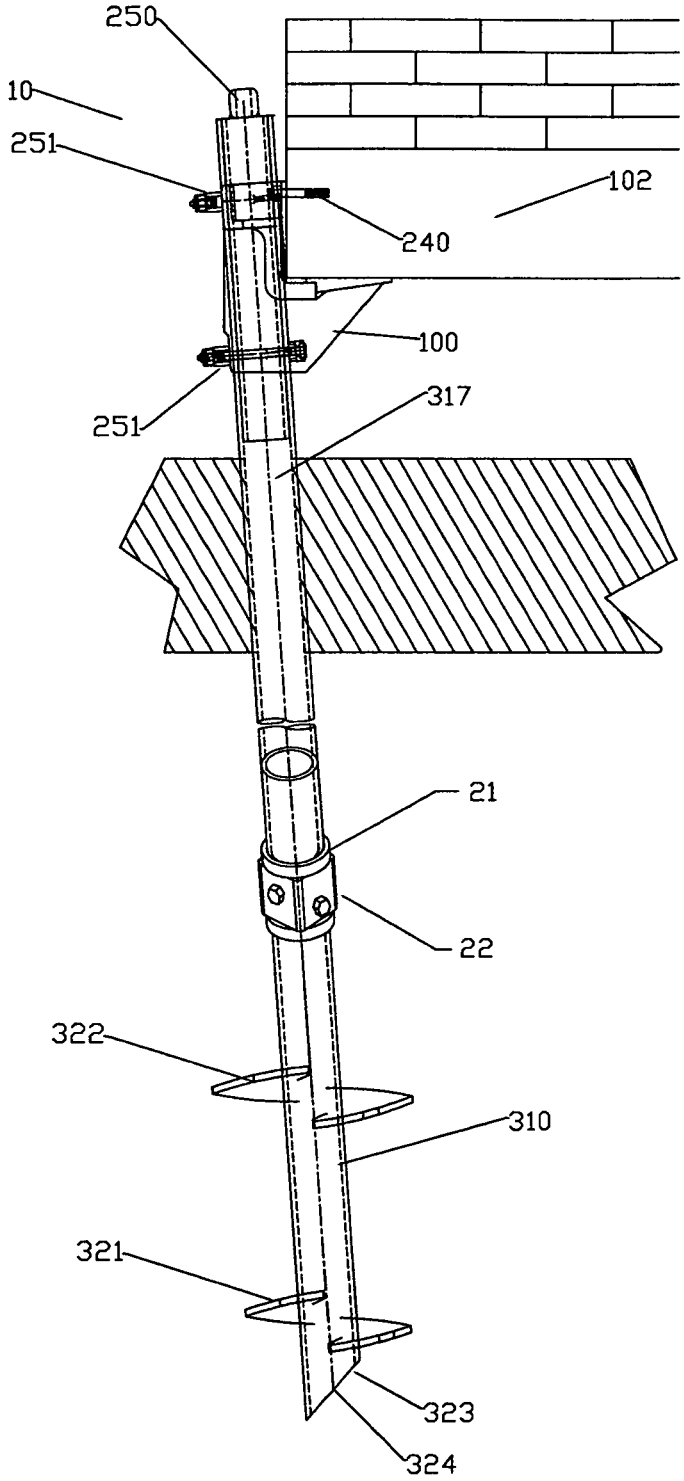
FIG. 13 depicts a side view of the bracket attached to a foundation.

As depicted in FIGS. 4 and 13, the pile 310 includes a helical plate that extends about an axis of the pile 310, referred to herein as the pile axis 317. As shown in FIG. 4, the pile 310 includes a first helical plate 321 and a second helical plate 322. The first helical plate 321 is located, generally, at the first end 323 of the pile 310. As shown therein, the first end 323 of the pile 310 includes a lead 324 shaped to penetrate the ground, or the material under the foundation 102. As depicted in FIG. 4, the second helical plate 322 is spaced axially from the first helical plate 321. In alternative embodiments, the pile 310 includes between 1 and 5 helical plates, spaced axially from one another. The helical plates 321, 322 are manufactured from a metal and welded to the pile 310. In one embodiment, the metal is a steel. In alternative embodiments, the helical plates 321, 322 are integrally cast with the pile 310.

FIG. 13, depicts one embodiment of the piling apparatus 10. As shown therein, two back straps, 251-*a* and 251-*b*, align and orient the pile 310 with the bracket 100. The first back strap 251-*a* is secured to the bracket 100 by way of fasteners. The fasteners are located within the first slot 413 and the second slot 414, as shown in FIG. 3 and the back strap holes 256, 258. As shown therein, the first side 252 of the back strap 251-*a* cooperates with the supporting T-pipe 250. The second back strap 251-*b* is secured to the bracket 100 by way of fasteners. The fasteners are located within the first and second hex recessed holes 327, 328 of the first and second lugs 325, 326. As shown therein, the first side 252 of the back strap 251-*b* cooperates with the pile 310. In a similar fashion, FIG. 4, depicts the first back strap 251-*a* and the second back strap 251-*b*, wherein the second sides 253, of the back straps 251-*a,b*, cooperate with the supporting T-pipe 250 to align and orient the pile 310 with the bracket 100. As FIG. 4 illustrates, the supporting T-pipe 250 is located between the first wall 311 and the second wall 312 of the bracket 100. The guide section 272 of the supporting T-pipe 250 receives the pile 310 and aligns and orients the pile with respect to the bracket 100.

Figure 14:
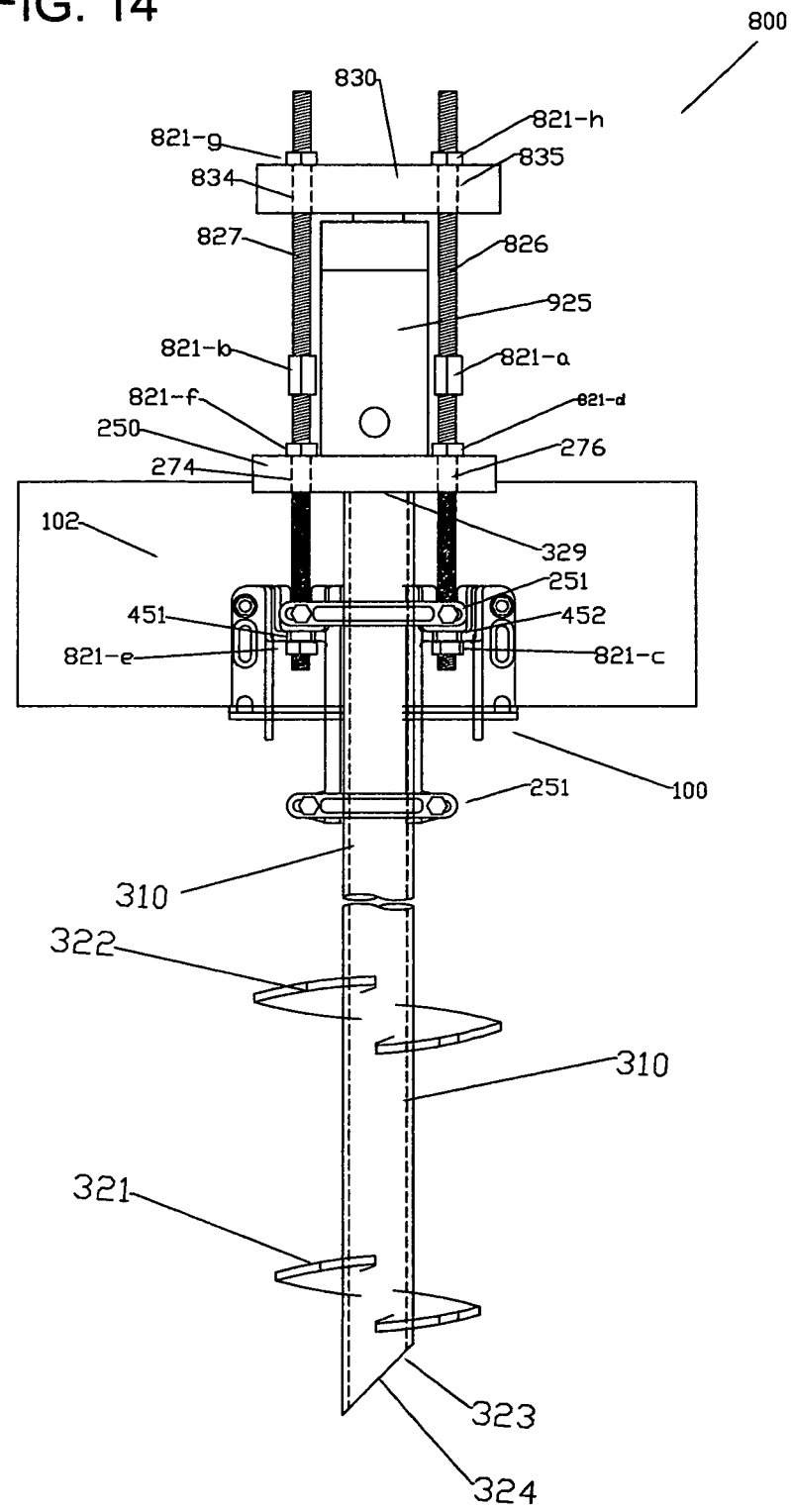
FIG. 14 depicts one embodiment of the lifting hardware and the bracket.

During operation, after the pile 310 has been driven, the supporting T-pipe 250 is located at the second end 329 of the pile 310. Thereafter, the lifting hardware 800 is attached to the supporting T-pipe 250 and the bracket 100. In order to lift, or raise, the foundation 102, a hydraulic ram 925, or jack, is located between the supporting T-pipe 250 and the plate 803. FIG. 14 depicts the lifting cylinder 925 located between the supporting T-pipe 250 and the plate 803. During operation, the lifting cylinder 925 extends to contact the plate 803 and provides the force required to lift the foundation 102. The force from the lifting cylinder 925 is transmitted to the plate 803, which, in turn, moves the bracket 100 towards the supporting T-pipe 250 and lifting the foundation 102 with it. The alignment between the plate 803 and the supporting T-pipe 250 is maintained by the threaded rods.

During this operation, the force of the lifting cylinder 925 lifts the foundation 102. Once the foundation 102 is located at the desired height, the fourth threaded member 821-*d* and the sixth threaded member 821-*f* are tightened to secure the supporting T-pipe 250 to the bracket 100. Thereafter, the lifting cylinder 925 is compressed and the lifting hardware 800 and lifting cylinder 925 are removed from the bracket 100.

Figure 15:
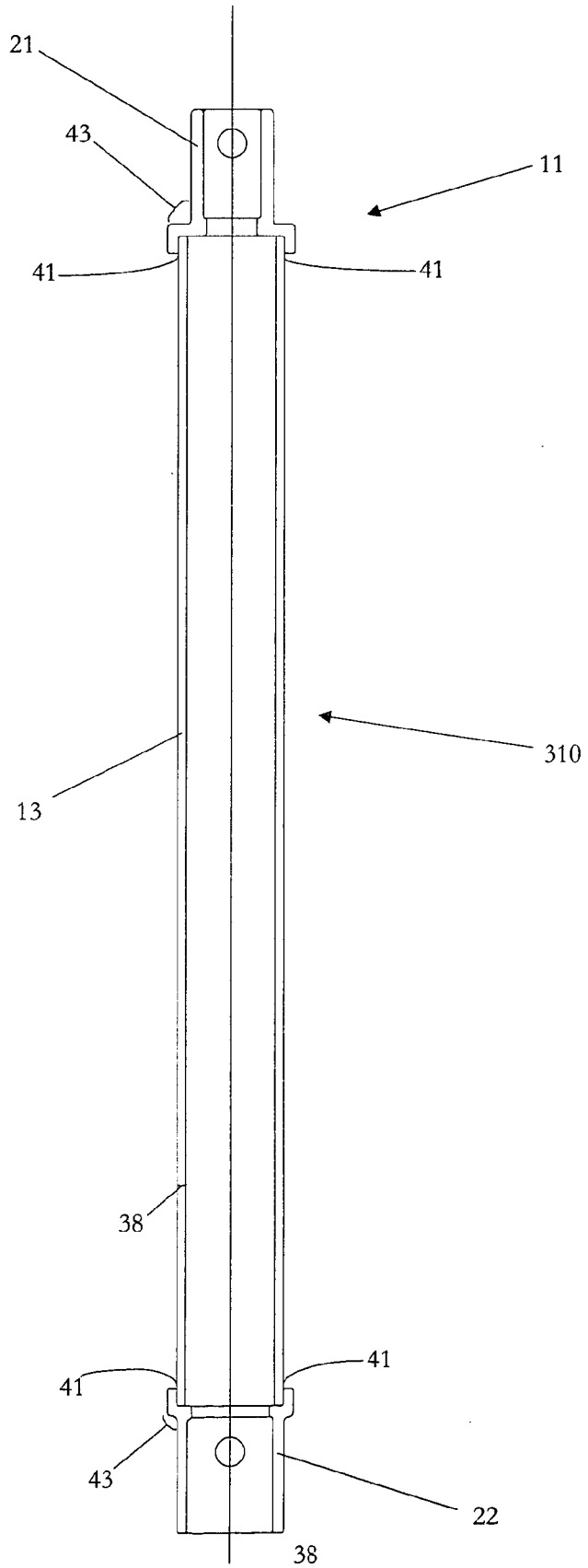
FIG. 15 depicts a cross-sectional view of a pile with end fittings.

FIG. 15 depicts a presently preferred embodiment of a pile 310. As shown therein, the pile 310 is provided with a first end 11 and a second end 12. As used herein, the term "end" is intended to include the extreme end, as well as portions extending from the extreme end towards the other end. The first end 11 includes a first end fitting 21 while the second end 12 is provided with a second end fitting 22. The pile 310 is also provided with a tubular section 13. In the presently preferred embodiment, the tubular section 13 is cylindrically shaped, yielding a cross-sectional shape that is circular, however, in other alternative embodiment cross-sectional shapes, such as square hexagonal, octagonal or other out-of-round shape is provided.

In use, the pile 310 is driven into the ground, preferably helically, via a hydraulic drive (not shown). After a pile is driven into the soil (referred to herein as a "driven pile"), another pile 310 is coupled thereto (referred to herein as a "following pile"). The hydraulic drive is then connected to the following pile. The following pile, together with the previously driven pile, is then helically driven into the ground (referred to herein as "successive piling").

Figure 16:
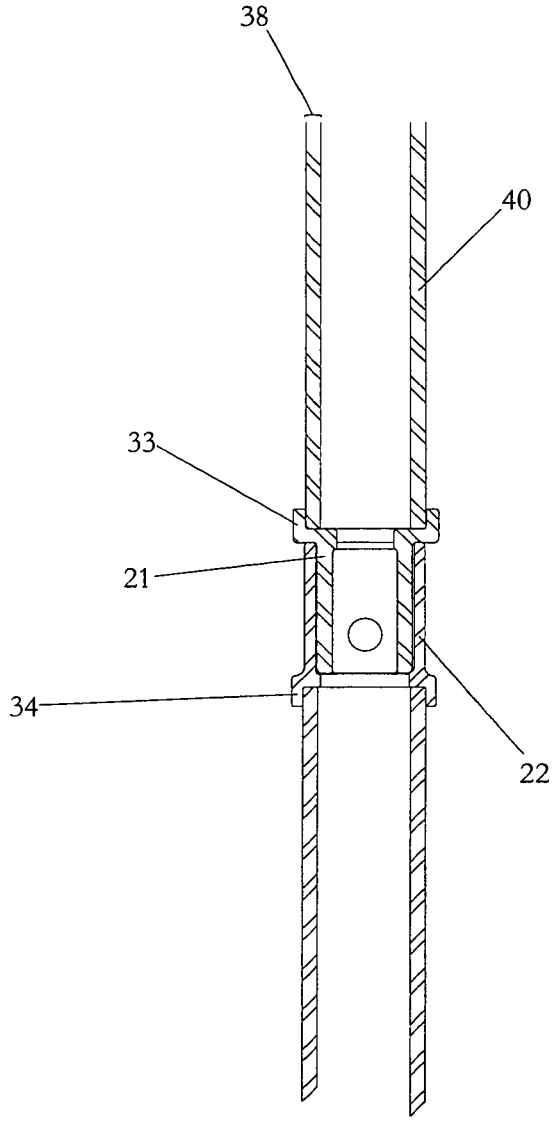
FIG. 16 depicts a cross-sectional view of two piles being coupled together via the end fittings.

The first end fitting 21 is provided with a first outer dimension 23 and a first inner dimension 24 while the second end fitting 22 is provided with a second outer and a second inner dimension 26. Referring now to FIG. 16, the first end fitting 21 is shaped to cooperate with the second end fitting 22. The first outer dimension 23 of the first end fitting measures less that the second inner dimension 26 of the second end fitting 22.

Figure 17:
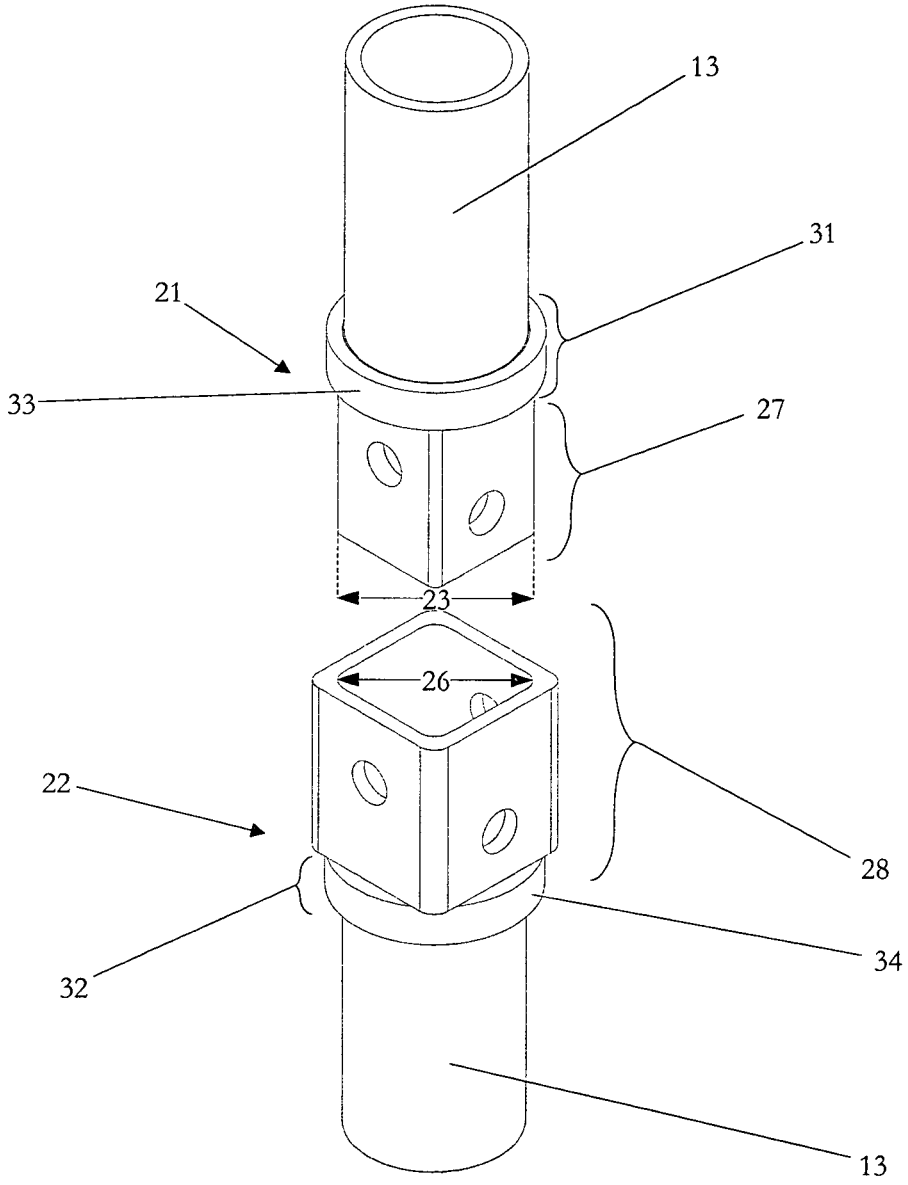
FIG. 17 depicts a perspective view of two piles placed in axial alignment so that a first end fitting can be placed into a second end fitting thereby coupling together the two piles.
Figure 30:
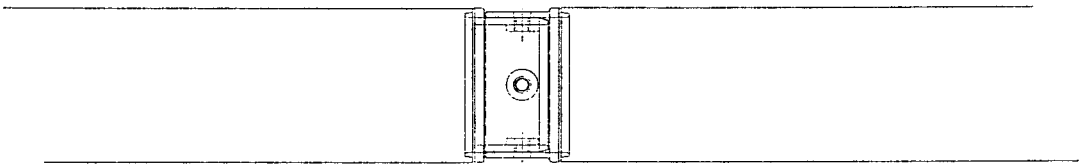
FIG. 30 depicts a perspective view of two piles being coupled together via the end fittings.

As FIG. 16 illustrates, at least a portion of the first end fitting 21 fits within the second end fitting 22. Thus, when successive piling is used, the first end fitting 21 of a following pile fits into the second end fitting of the previously driven pile 310 (as is shown in FIG. 30). As FIG. 17 illustrates, each of the end fittings 21, 22 is provided with a coupling extension. The coupling extensions 27, 28 on the end fittings 21, 22 are dimensioned so that tapped holes 29, 30 on each of the end fittings 21, 22 can be placed in alignment when a following pile is connected to a previously driven pile, such as through use of a threaded bolt.

Figure 24:
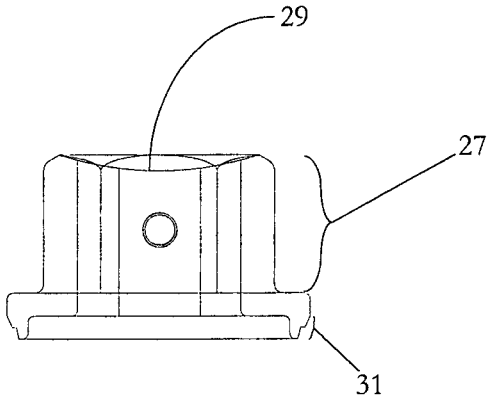
FIG. 24 depicts a perspective view of an end fitting.
Figure 25:
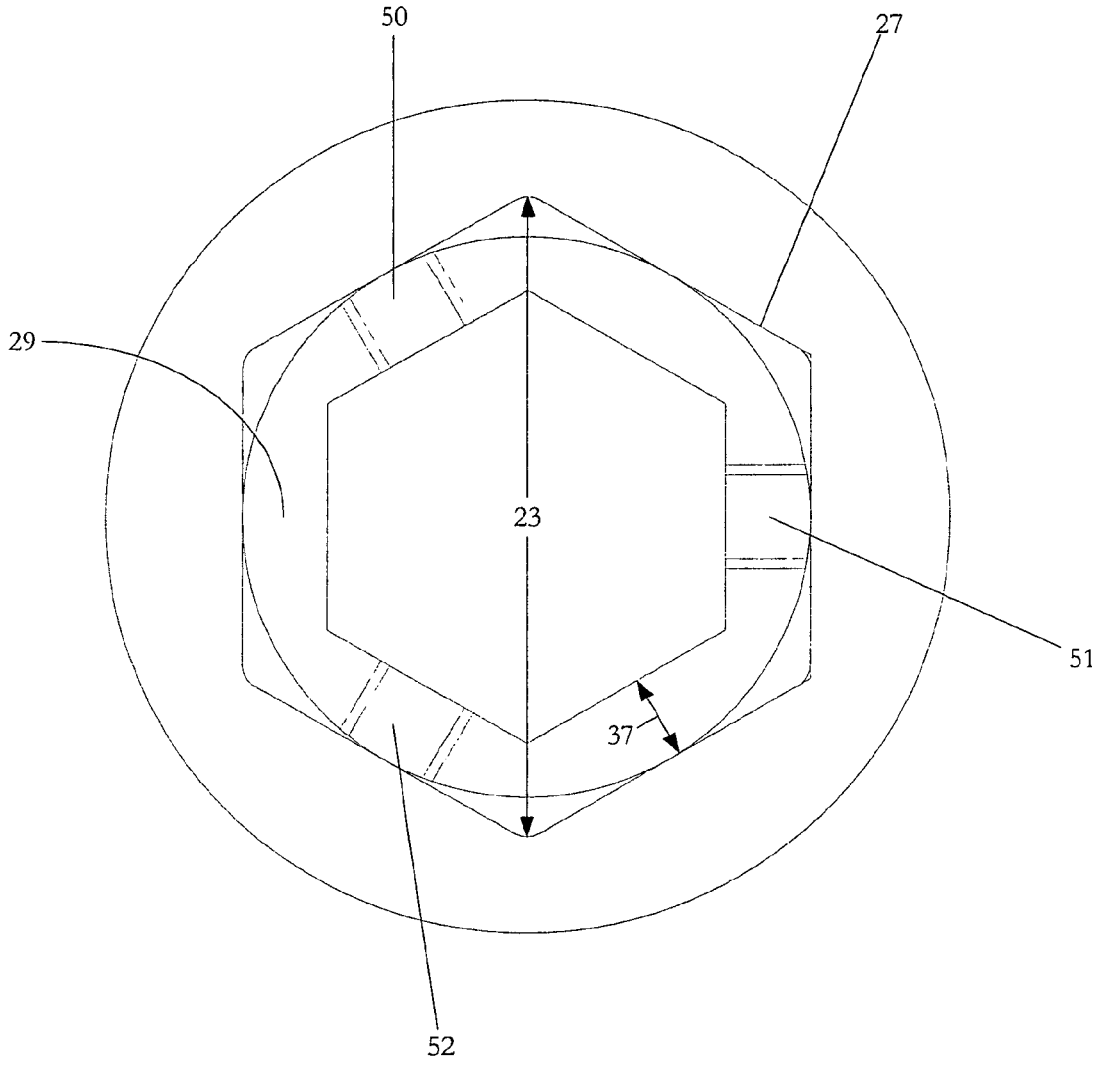
FIG. 25 depicts a top-down view of an end fitting.

Each of the coupling extensions 27, 28 is configured to transmit torque. As illustrated in FIG. 17, extensions 27, 28 are provided with a cross-sectional shape that is out-of-round, preferably square. In FIG. 24 and FIG. 25, however, end fittings are depicted with coupling extensions 27, 28 that are hexagonal in cross-sectional shape. In yet another alternative embodiment, the coupling extensions 27, 28 are octagonal in cross-sectional shape. As is also illustrated herein, each of the coupling extensions 27, 28 is provided with a first thickness 37 while the pipe 40 and the tubular section 13 of FIG. 15 are provided with a second thickness. In the presently preferred embodiment, the first thickness 37 of the coupling extensions 27, 28 is greater than the second thickness 38 of the pipe 40 and the tubular section 13. Thus, a pipe or tubular section with a reduced thickness 38 has ends that are provided with a greater thickness 37.

Advantageously, the first end fitting 21 includes a plurality of first outer dimensions 23 so as to provide the coupling extension 27 with a tapered shape, preferably a tapered shape wherein the outer dimension 23 increases as the coupling extension 27 extends from the pipe-accepting end 31 (hereinafter referred to as an "increasing tapered shape"). Conversely, the second end fitting 22 includes a plurality of second inner dimensions 26 so as to provide the coupling extension 28 with a tapered shape, preferably a tapered shape wherein the inner dimension 26 decreases as the coupling extension 28 extends from the pipe-accepting end 32 (hereinafter referred to as a "decreasing tapered shape").

It is preferred that the tapered shape of one end fitting correspond to the tapered shape of the other end fitting. Thus, in the case of the end fitting embodiments shown herein, the increasing tapered shape of the first end fitting 21 corresponds to the decreasing tapered shape of the second end fitting 22 so that when the first end fitting 21 of a following pile is placed into the second end fitting 22 of a previously driven pile, the end fittings 21, 22 are axially aligned with greater ease.

The coupling extension 27 of the first end fitting 21 is configured to be placed within the coupling extension 28 of the second end fitting 22. For greater ease in placing the coupling extension 27 of the first end fitting 21 within the coupling extension 28 of the second end fitting 22, the decreasing tapered shape of the second end fitting 22 includes a spherical surface 29, as is shown in FIG. 24.

Figure 18:
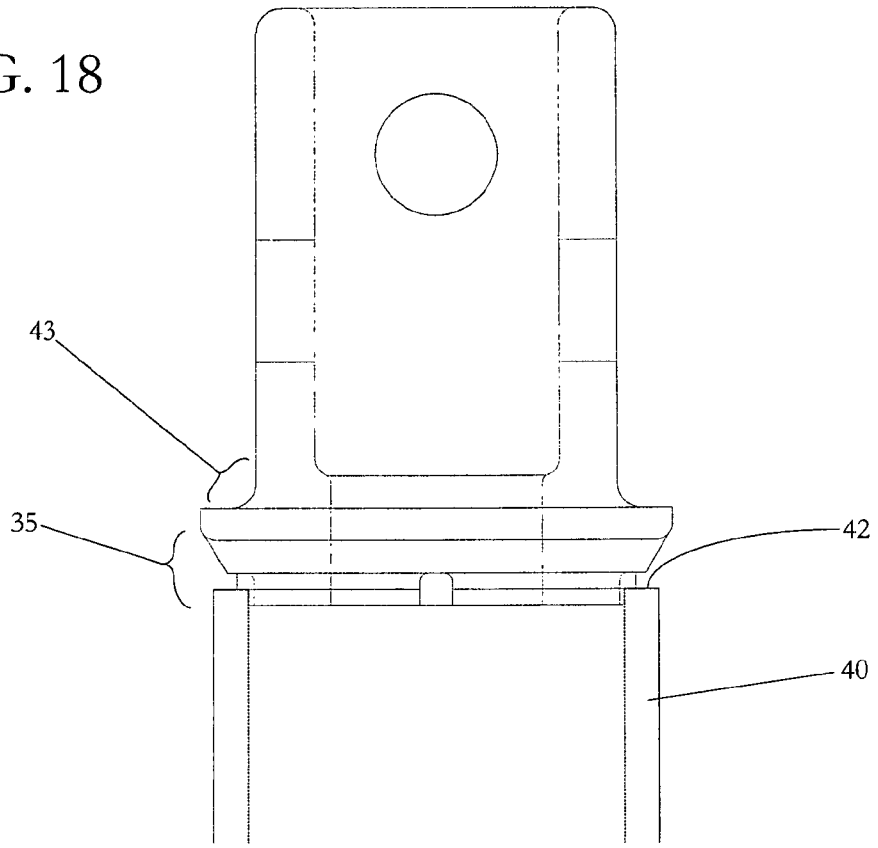
FIG. 18 depicts a perspective view of an end fitting on a pipe with a cross-sectional view shown in dashed lines.
Figure 19:
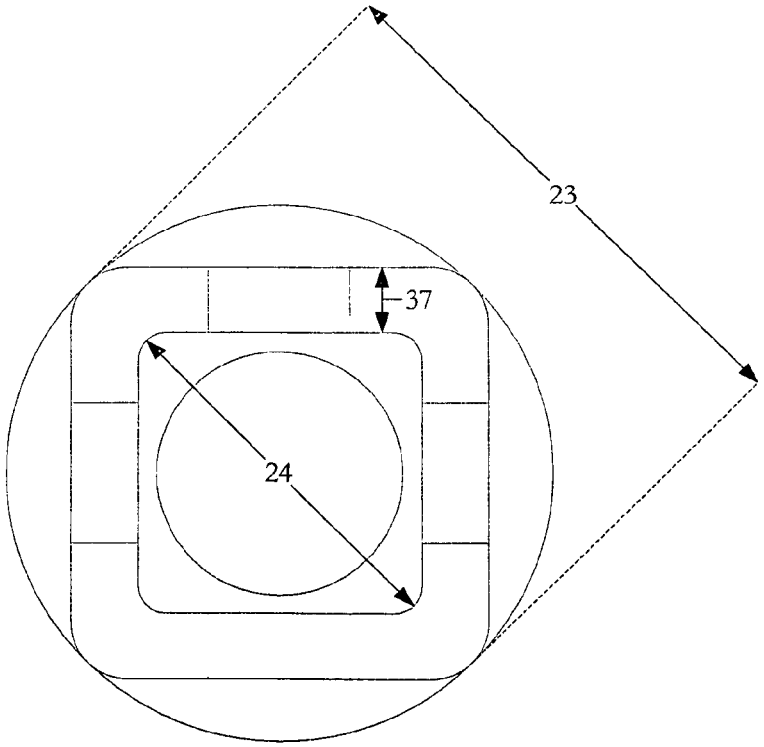
FIG. 19 depicts a top-down view of the end fitting shown in FIG. 18.

In the presently preferred embodiment, each of the end fittings 21, 22 is provided with a pipe-accepting end. FIG. 17 depicts the first end fitting 21 with a pipe-accepting end 31 and the second end fitting 22 with a second pipe -accepting end 32. The pipe-accepting ends 31, 32 are shaped according to the cross-sectional shape of the tubular section 13 of the pile 310. Advantageously, the pipe-accepting ends 31, 32 are shaped to place the end-fitting and the tubular section in axial alignment. As FIG. 17 illustrates, the pipe-accepting ends 31, 32 are each in the form of a flange that extends to enlarged sections 33, 34 that are cylindrically shaped. FIG. 18 and 19 depict alternative embodiments of the first and second end fittings 21, 22. As shown therein, the end fittings 21, 22 are provided with pipe-accepting ends 31, 32 that taper to reduced portions 35, 36 that are frustro-conically-shaped.

Figure 20:
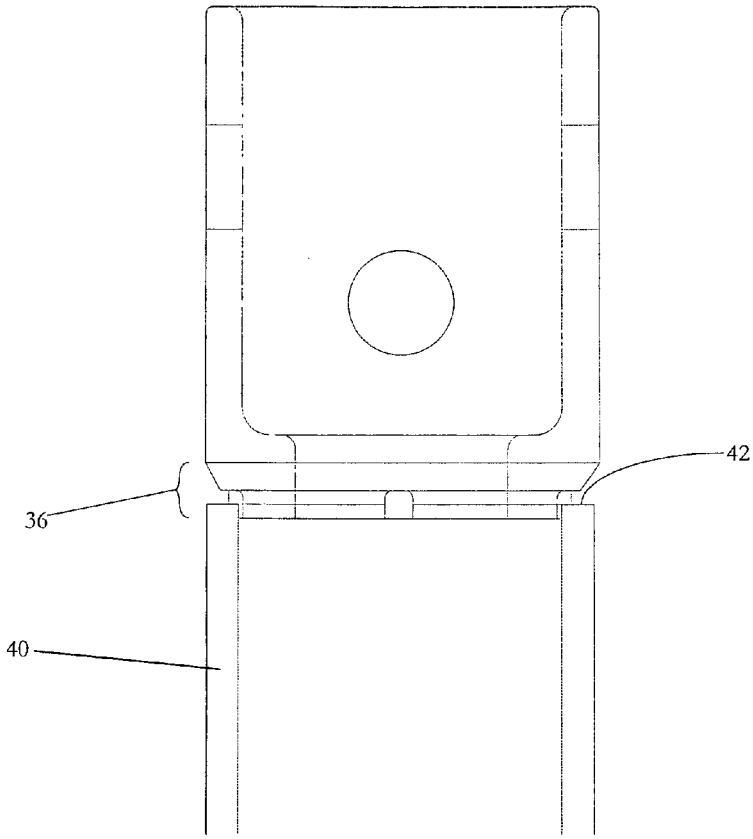
FIG. 20 depicts a perspective view of an end fitting that accepts the end fitting shown in FIG. 18 and a cross-sectional view shown in dashed lines.
Figure 21:
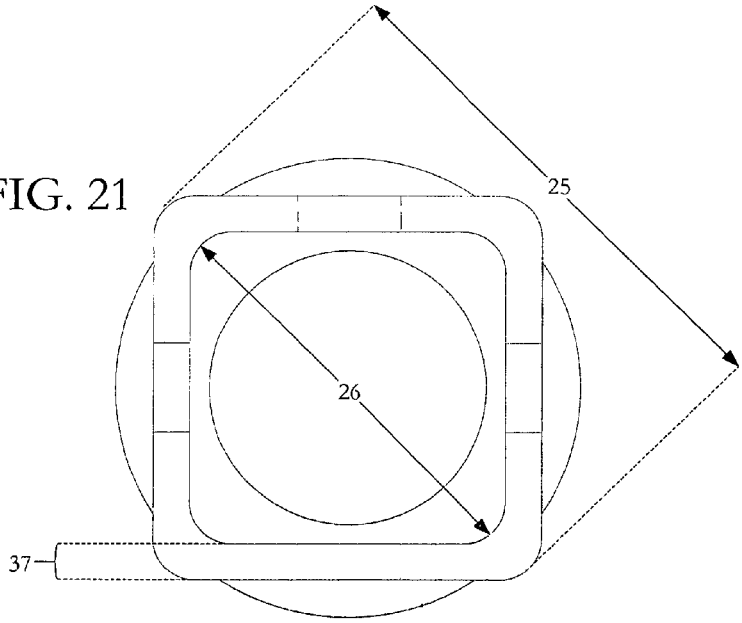
FIG. 21 depicts a top-down view of the end fitting shown in FIG. 20.

In the presently preferred embodiment, the end fittings 21, 22 are cast using a lost wax technique from steel; however, in alternative embodiments, the end fittings 21, 22 are cast in sand or lost foam. Then, the end fittings 21, 22 are welded on ends of a pipe 40. As FIG. 16 and 17 illustrate, the enlarged sections 33, 34 extend over the ends of the pipe thereby enabling each of the end fittings 21, 22 to be welded to the external portion 41 of the pipe 40 where the flange of the end fitting meets the pipe 40 itself. However, in alternative embodiments, the pipe-accepting ends 31, 32 extend, at least in part, within the pipe, as is depicted in FIGS. 18 and 20. As illustrated therein, the reduced portions 35, 36 partially extend within the pipe 40, and end fittings and the pipe 40 are welded together where the annular portion 42 of the pipe 40 meets the reduced portions of the end fittings 21, 22.

As FIGS. 15 and 18 illustrate, a transition 43 links the coupling extension with the pipe-accepting end. Thus, the transition 43 enables the end fitting to include a plurality of cross-sectional shapes. In the presently preferred embodiment, the transition 43 links a coupling extension that is shaped to transmit with a pipe-accepting end that is shaped to place the end fitting and the tubular section in axial alignment, because the coupling extension and the pipe-accepting end of the end fittings serve different purposes, it may be advantageous to provide each with cross-sectional shapes that differ from one another. Thus, in the case of the presently preferred embodiment, the transition 43 links a coupling extension that is square in cross-sectional shape with a pipe-accepting end that is circular in cross-sectional shape. In alternative embodiments, transitions link coupling extensions that are octagonal in cross-sectional shape with pipe-accepting ends that are circular in cross-sectional shape. In still other alternative embodiments, transitions link coupling extensions and pipe-accepting ends that are provided with cross-sectional shapes that are the same but that differ in physical dimension (e.g. small squares linked with larger squares).

Figure 22:
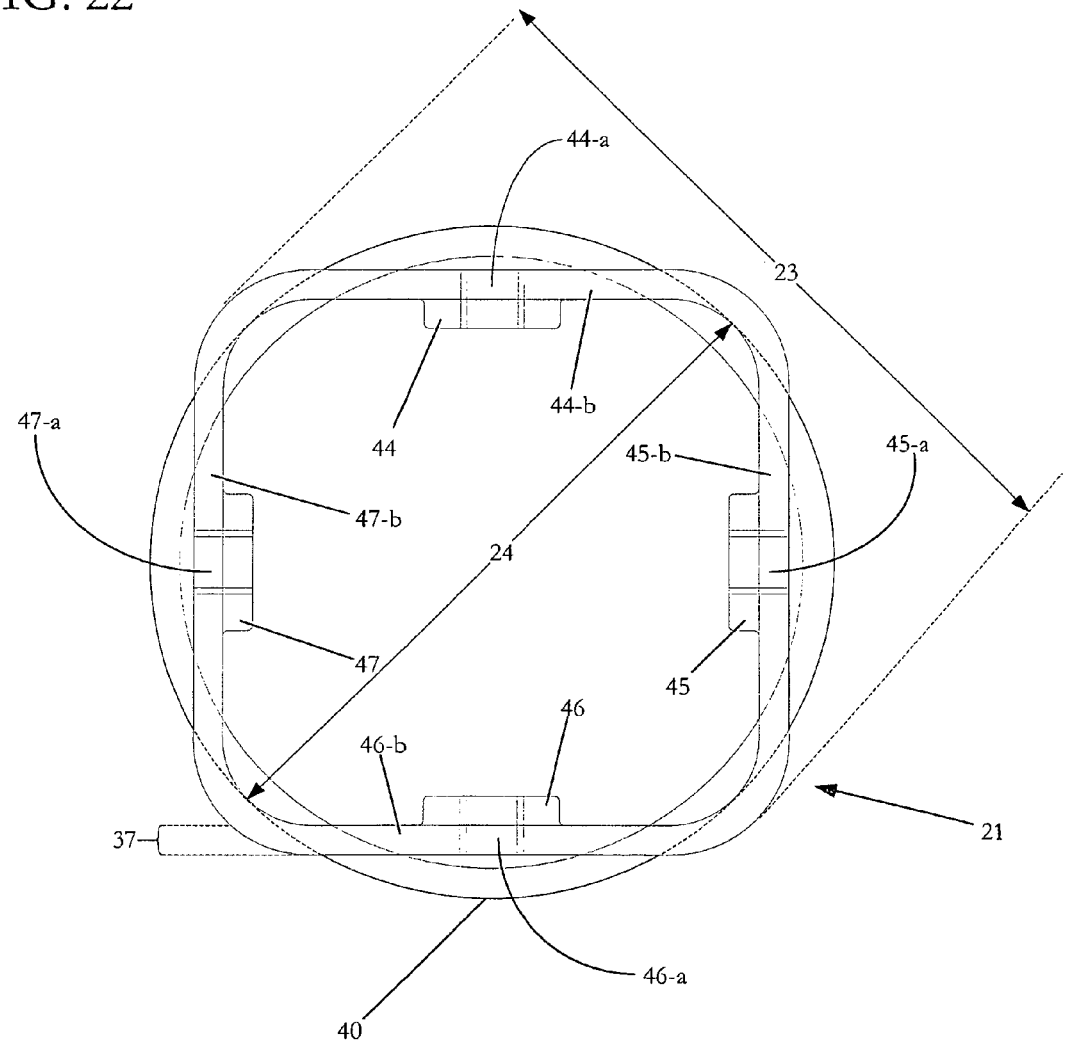
FIG. 22 depicts a top-down view of an end fitting.
Figure 23:
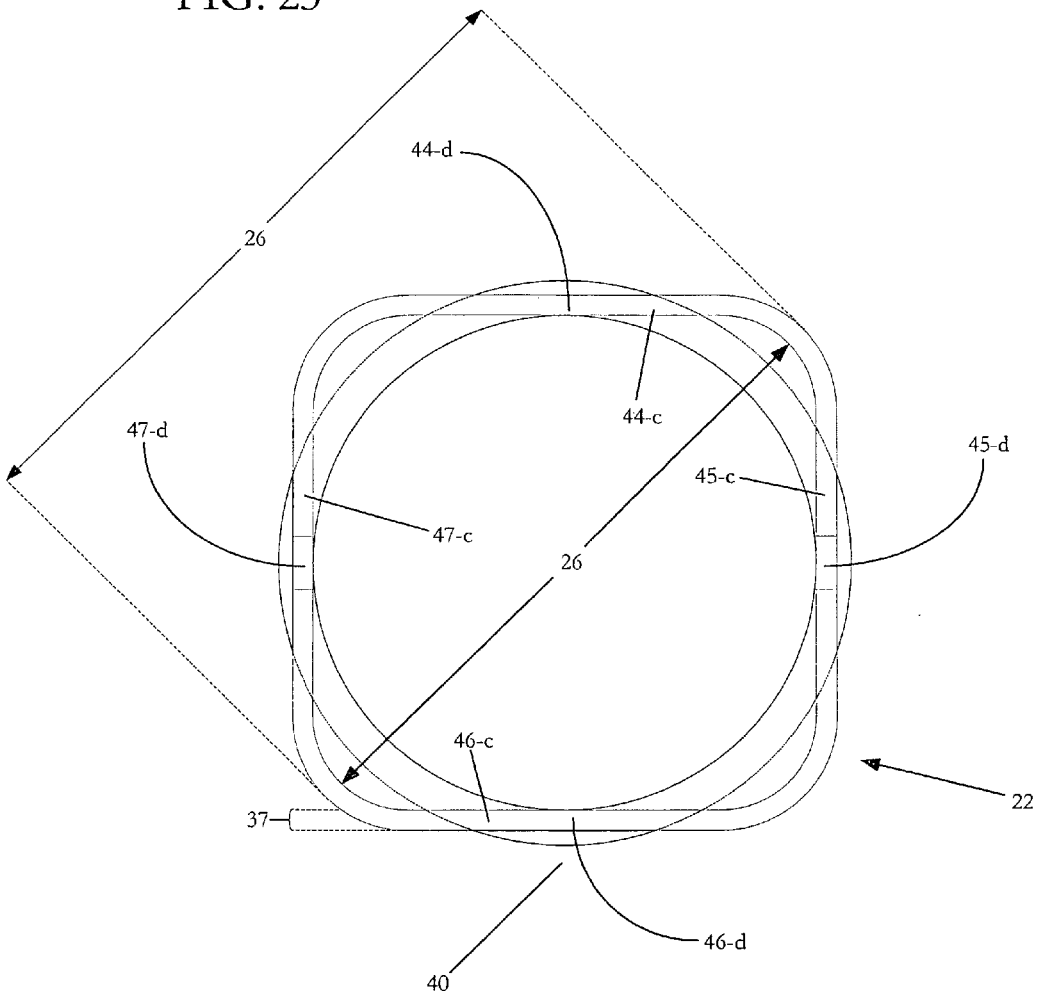
FIG. 23 depicts a top-down view of an end fitting.

Referring now to FIG. 22, a piling 310 is shown looking into a first end fitting 21. As shown therein, the first end fitting 21 is provided with a plurality of enlarged portions 44, 45, 46, and 47. The enlarged portions 44, 45, 46, 47 are located where the first end fitting 21 is provided with a plurality of tapped holes (which in FIG. 22 are designated 44-*a*, 45-*a*, 46-*a*, 47-*a*). The enlarged portions 44, 45, 46, 47 and the tapped holes 44-*a*, 45-*a*, 46-*a*, 47-*a* of the first end fitting 21 cooperate with a bolt (not shown). When the first end fitting 21 is placed within a second end fitting 22 (such as the second end fitting 22 shown in FIG. 23), the enlarged portions 44, 45, 46, 47 function as a plurality of female fasteners.

When the walls 44-*b*, 45-*b*, 46-*b*, 47-*b* of the first end fitting 21 are placed within the walls 44-*c*, 45-*c*, 46-*c*, 47-*c* of the second end fitting 22 and the tapped holes 44-*a*, 45-*a*, 46-*a*, 47-*a* of the first end fitting 21 are aligned with the holes 44-*d*, 45-*d*, 46-*d*, 47-*d* of the second end fitting 22 so that bolts can be passed through, the walls 44-*b*, 45-*b*, 46-*b*, 47-*b* of the first end fitting 21 and the walls 44-*c*, 45-*c*, 46-*c*, 47-*c* of the second end fitting 22 can be shaped so as to provide a spring-effect that stretches the bolts, much as a washer stretches a bolt in a standard nut-washer-and-bolt fastening assembly. By way of example and not limitation, the walls of either the first end fitting 21 or the second end fitting 22 (or both) can bow away from each other, thereby creating a "spring-effect" when the respective walls of the end fittings 21, 22 are fastened towards each other when the bolts are torqued into the enlarged portions 44, 45, 46, 47 of the first end fitting 21.

Figure 26:
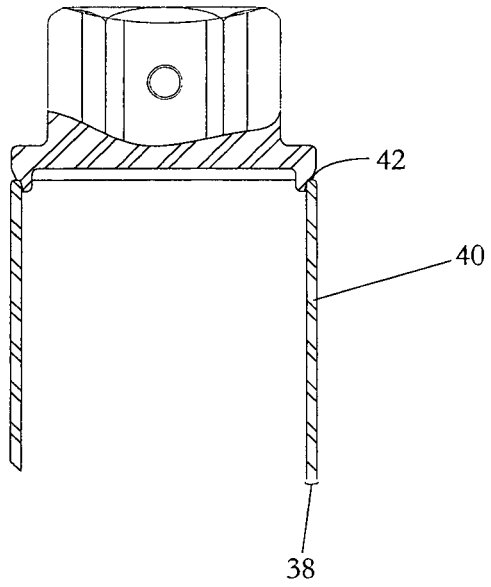
FIG. 26 depicts a partial cross-sectional view and a partial perspective view of a piling.
Figure 27:
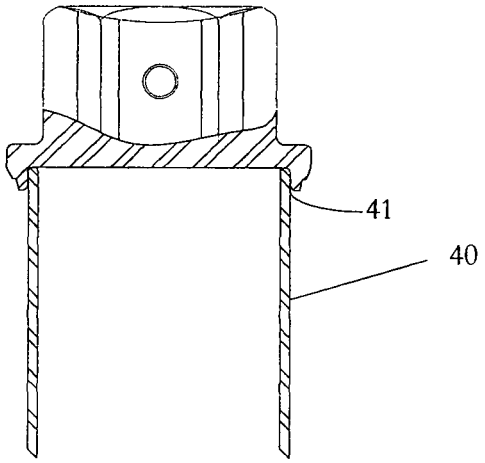
FIG. 27 depicts a partial cross-sectional view and a partial perspective view of a piling.

Referring now to FIG. 24 and FIG. 25, a first end fitting 21 is shown. As illustrated, the first end fitting 21 is provided with a coupling extension 27 that is hexagonal is cross-section and a pipe-accepting end 31 that is configured to cooperate with pipes 40 having a plurality of diameters. FIG. 26 and FIG. 27 illustrate the first end fitting 21 of FIG. 24 in a partially sectionalized view and better depict the pipe-accepting end 31. As shown in FIG. 26, the pipe-accepting end 31 is welded to the annular portion 42 of the pipe 40 while in FIG. 27, the pipe-accepting end is welded to the external portion 41 of the pipe 40. The first end fitting 21 of FIG. 24 is provided with a pile guide 29 that is spherically shaped and a plurality of tapped holes 50, 51, 52 that cooperate with tapped holes provided on the second end fitting 22.

Figure 28:
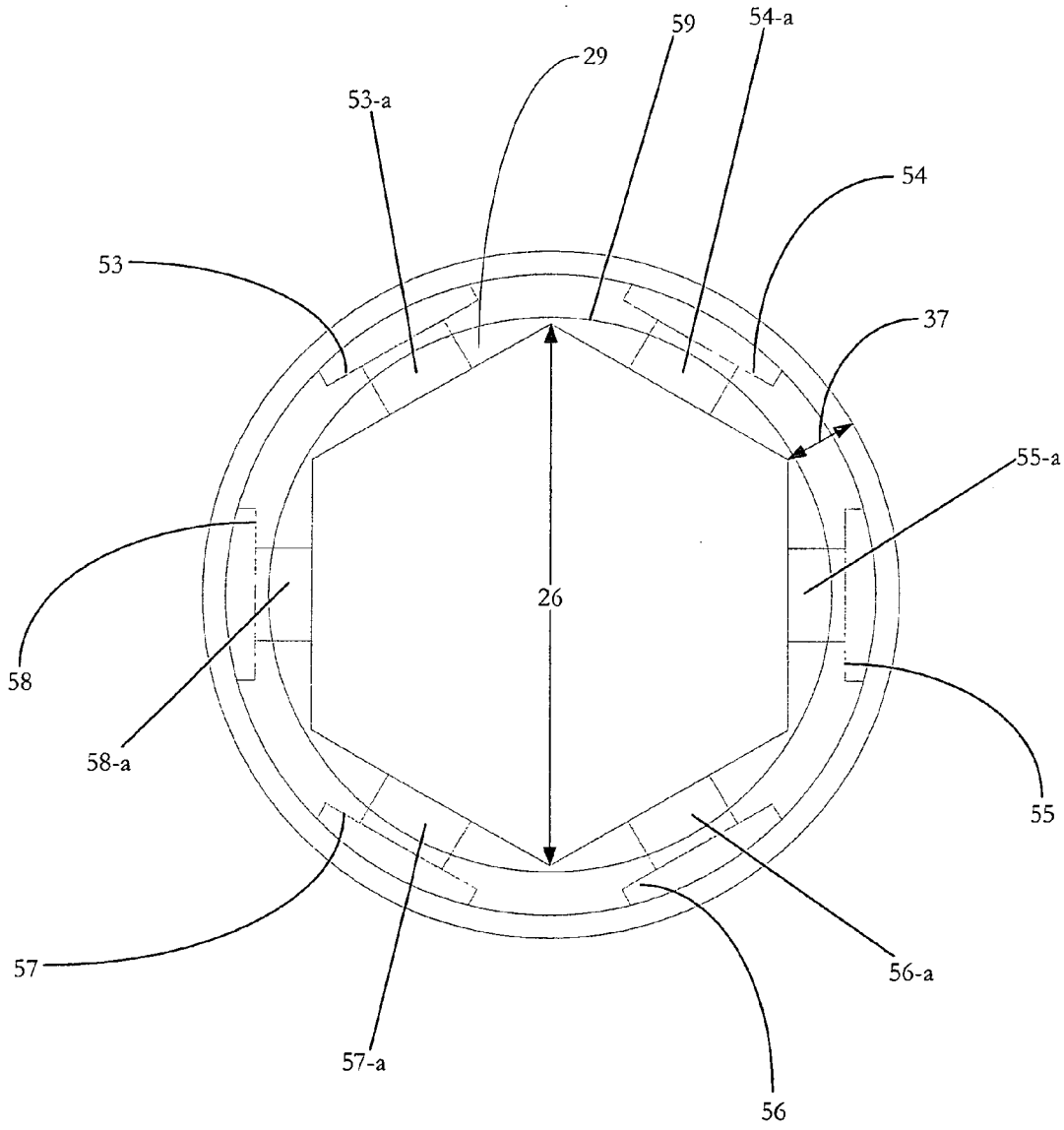
FIG. 28 depicts a top-down view of an end fitting.
Figure 29:
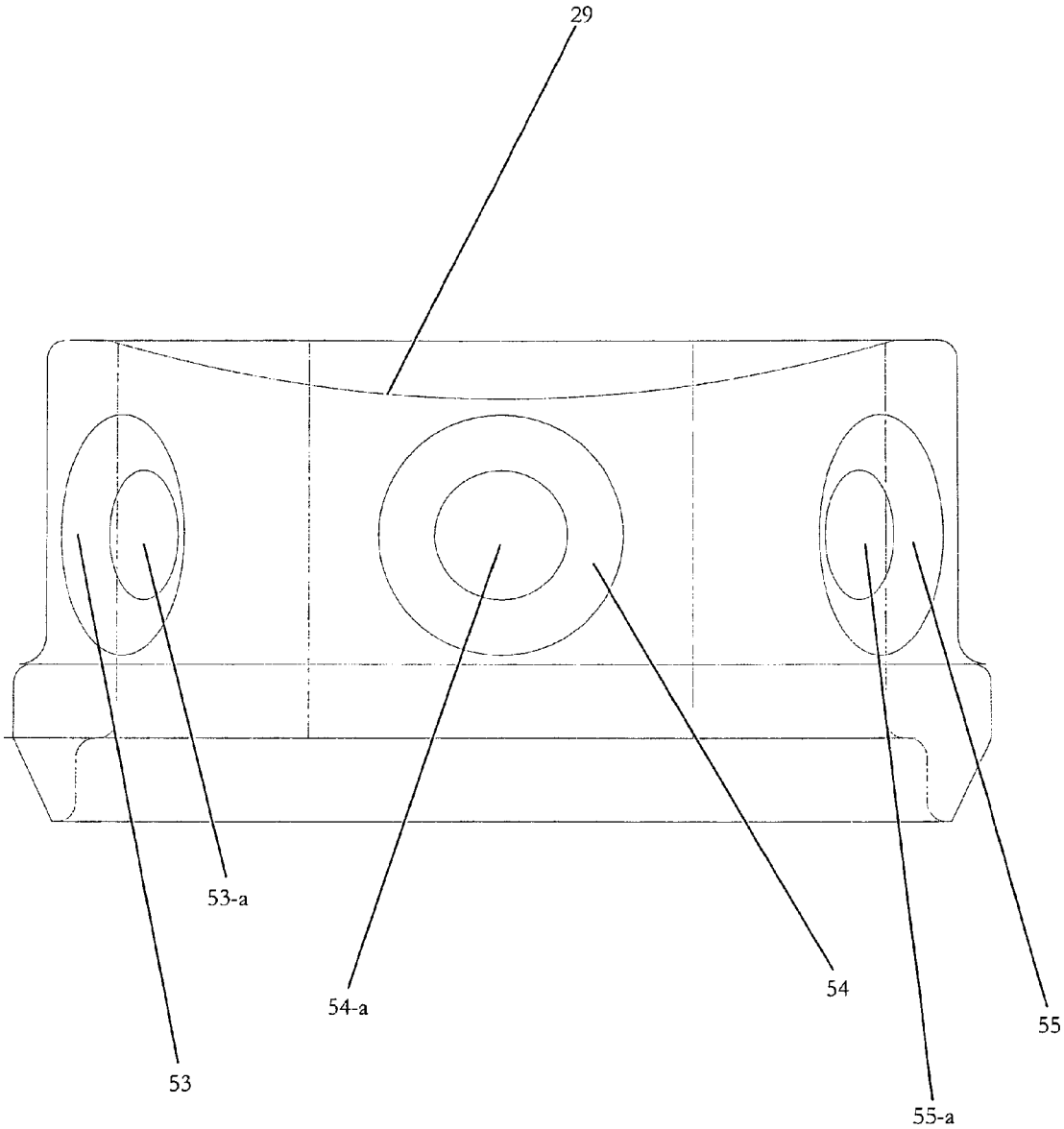
FIG. 29 depicts a perspective view of an end fitting.

An alternative embodiment of the second end fitting 22 is depicted in FIG. 28 and FIG. 29. As shown therein the second end fitting 22 is provided with a cylindrically shaped outer wall 59, a plurality of guides 53, 54, 55, 56, 57, 58, and a plurality of tapped holes 53-*a*, 54-*a*, 55-*a*, 56-*a*, 57-*a*, 58-*a*. The guides 53, 54, 55, 56, 57, 58 are shaped to guide bolts into threaded engagement with the tapped holes 53-*a*, 54-*a*, 55-*a*, 56-*a*, 57-*a*, 58-*a* when the first end fitting 21 is placed within the second end fitting 22. In the presently preferred embodiment, the guides 53, 54, 55, 56, 57, 58 are spherically shaped and extend from the outer wall 59 towards the tapped holes 53-*a*, 54-*a*, 55-*a*, 56-*a*, 57-*a*, 58-*a*.

As illustrated in both FIG. 28 and FIG. 29, the second end fitting 22 is provided with a pile guide 29 that is shaped to place the first and second end fittings into axial alignment when successive piling is used. As shown herein, the pile guide 29 is spherically shaped; however, in alternative embodiments, the pile guide 29 is frusto-conically shaped.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A piling apparatus, comprising:

a) a pile, including i) a first end and a second end wherein the first end is configured to cooperate with the second end; and ii) a lead that is configured to be driven into the ground; and b) a bracket, including i) a cast iron metallurgical structure;

ii) a supporting structure provided with:

(1) a leading edge shaped to be driven under a foundation;

(2) a support area;

(3) a support backing that is provided with a first backing surface that is configured to face the foundation and a second backing surface;

(4) a first stand coupler provided with a first stand shelf;

(5) a second stand coupler provided with a second stand shelf;

(6) the stand shelves extend from the second backing surface; and (7) an aligner cavity extending through the support backing configured to locate the pile within the aligner cavity;

iii) a guide located on the second backing surface that is provided with:

(1) a first wall and a second wall wherein each of the walls includes an inner wall surface and an outer wall surface; and (2) the inner wall surfaces of the first and second walls face each other so as to provide a guide for a pile.

2. The piling apparatus according to claim 1, further comprising a tubular section wherein:

a) the first end and the second end are shaped cross-sectionally to transmit torque and are provided with a first thickness;

b) the first end is provided with a first outer dimension and a first inner dimension while the second end is provided with a second outer dimension and a second inner dimension;

c) the first outer dimension of the first end measures less than the second inner dimension of the second end;

d) the tubular section extends between the first end and the second end and is provided with a second thickness; and e) the first thickness of the ends is greater than the second thickness of the tubular section.

3. The piling apparatus according to claim 1, further comprising a back strap.

4. The piling according to claim 1 wherein at least one of the ends is provided with a cast steel metallurgical structure.

5. The piling according to claim 1, wherein at least one of the ends is provided with an out-of-round shape.

* * * * *